United States Patent [19]

Anderson et al.

[11] Patent Number: 5,071,128

[45] Date of Patent: Dec. 10, 1991

[54] SIMULATED FOOTBALL GAME APPARATUS

[76] Inventors: Roland W. Anderson; William R. Anderson, both of 16032 Dawn Dr., Minnetonka, Minn. 55345

[21] Appl. No.: 572,400

[22] Filed: Aug. 27, 1990

[51] Int. Cl.[5] ..... A63F 7/06; A63F 7/22

[52] U.S. Cl. ..... 273/94; 273/120 A

[58] Field of Search ..... 273/94, 85 R, 85 A, 273/142 E, 142 F, 142 G, 93 R

[56] References Cited

U.S. PATENT DOCUMENTS

| | | | |
|---|---|---|---|
| 848,351 | 3/1907 | De Walt | 273/93 R |
| 1,580,305 | 4/1926 | Koegle | 273/93 R |
| 2,140,193 | 12/1938 | Weinberger | 273/94 R |
| 2,230,767 | 2/1941 | Strattman | 273/94 R |
| 2,239,431 | 4/1941 | Shepherd | 273/94 R |
| 2,275,306 | 3/1942 | Morrison et al. | 273/94 R |
| 2,463,909 | 3/1949 | Ruch | 273/94 R |
| 3,409,298 | 11/1968 | Woods et al. | 273/94 R |
| 3,630,522 | 12/1971 | Bear | 273/94 R |
| 3,727,915 | 4/1973 | Anderson | 273/94 R |

*Primary Examiner*—Edward M. Coven
*Assistant Examiner*—Steven B. Wang
*Attorney, Agent, or Firm*—Clayton R. Johnson

[57] ABSTRACT

A simulated football game having a magnetic disc rollable out of a chute onto a scrimmage field on which defense players having a piece of iron embedded therein are movably situated, a huddle being releasably retained to retain the disc in the chute. The disc is used for determining running play yardage, the disc being rollable into a defense player. A calculator wheel is rotated in only one direction by dual gears regardless of the direction of rotation of the gears and simultaneously moves a marker over a marker field to indicate the position of a football relative to the marker field. The wheel is used to ascertain yardage resulting from passing, and other type plays. A marble carrier is rotated a fraction of a complete revolution each time a plunger is depressed for indicating a play and releasing the huddle to allow a disc to roll out of the chute. The carrier in being rotated, at times, discharges a marble to roll onto the scrimmage field for indicating whether there is a penalty or a fumble. A pass passage directs a bearing to roll onto the scrimmage field and may roll beneath one of a pass defender and a pass receiver to indicate an interception or a reception respectively.

26 Claims, 16 Drawing Sheets

FIG. 6
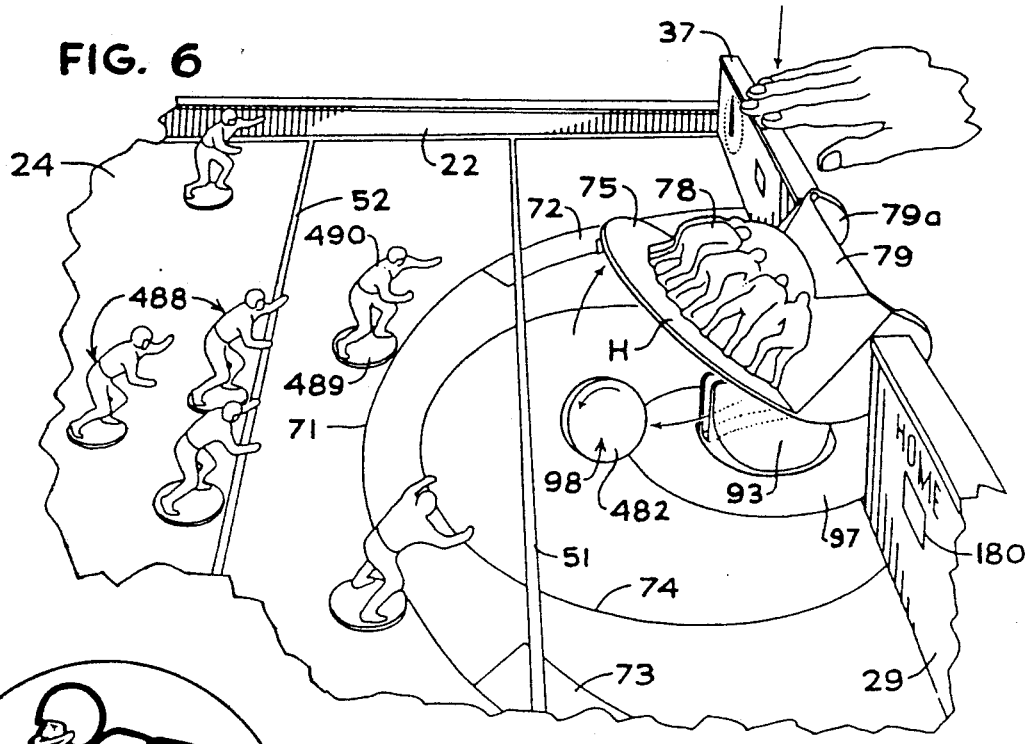
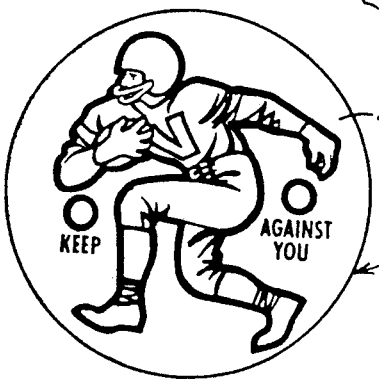
FIG. 24
FIG. 7
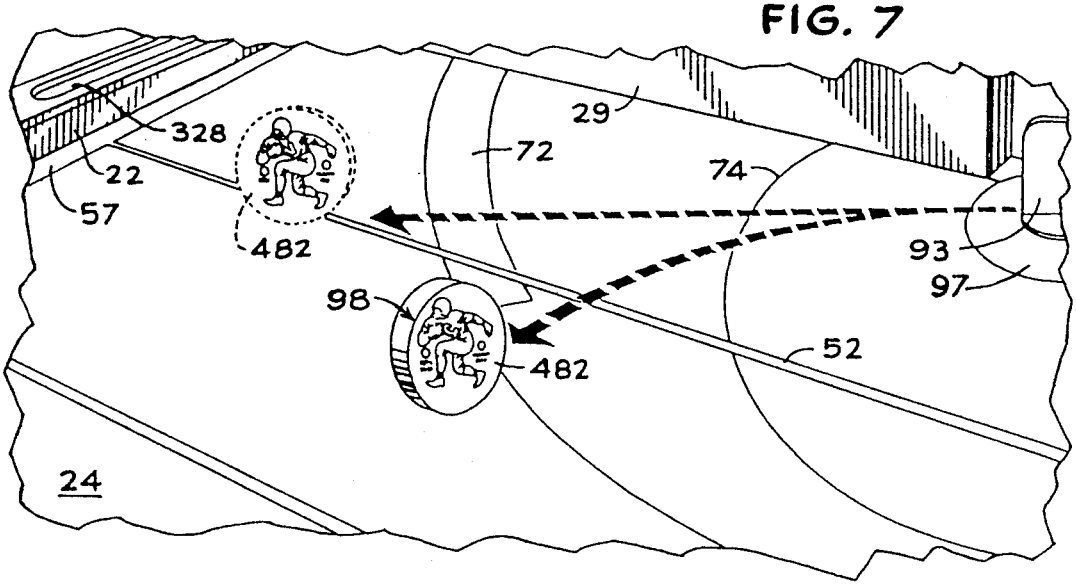

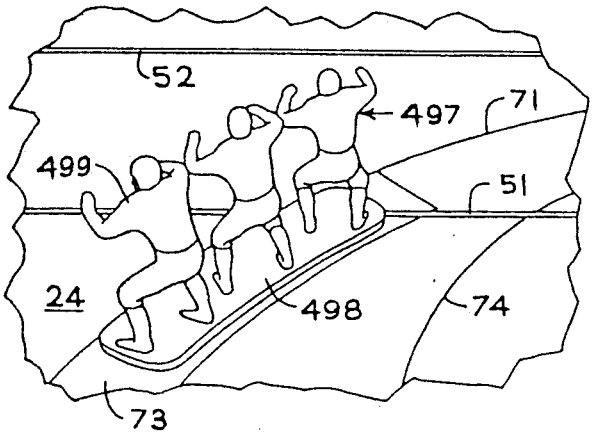
FIG. 11
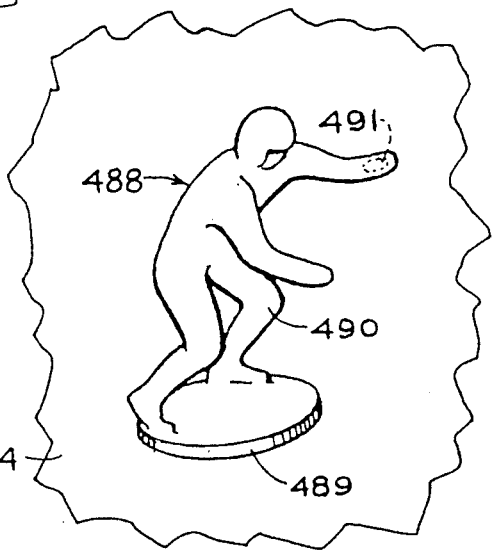
FIG. 27
FIG. 14
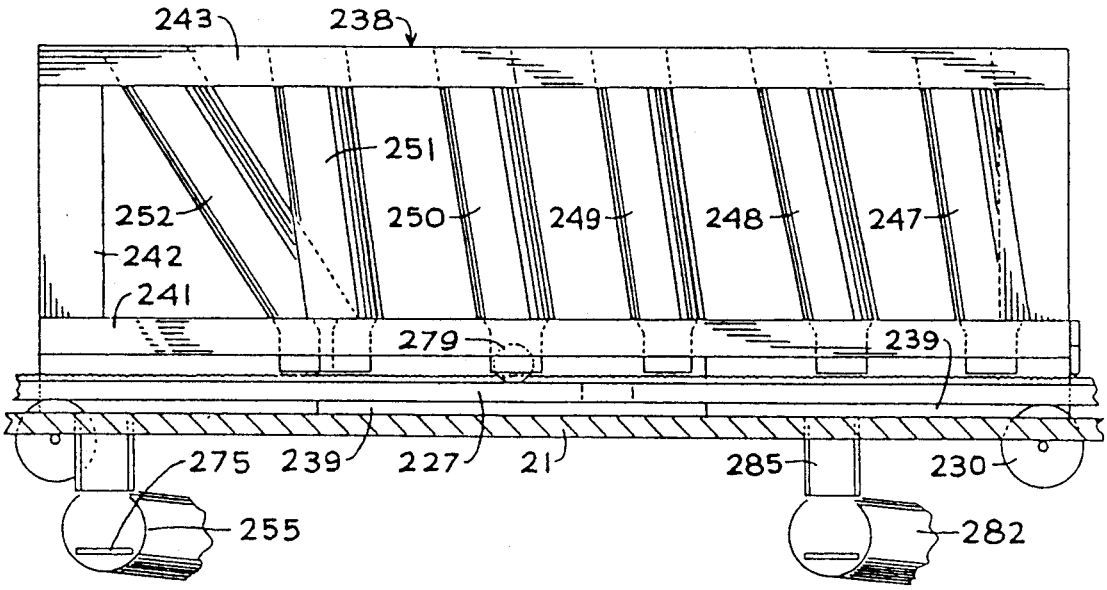

SIMULATED FOOTBALL GAME APPARATUS

BACKGROUND OF THE INVENTION

Football game apparatus that includes a table having a game surface representing at least a portion of a football field, at least one marble or bearing and simulated players.

In my U.S. Pat. No. 3,727,915 there is disclosed a simulated football game that has one end portion representing a scrimmage field on which players are placed and is inclined downwardly, a huddle mechanism for releasing a marble to roll passed or into defensive players, a marking field at the opposite end portion from the scrimmage field for keeping track of the progress of the game, cylinders to indicate the play results, mixing trays and an indicator wheel. The apparatus permits the simulation of running, passing and kicking plays.

In Wylie, U.S. Pat. No. 2,069,515, there is disclosed a table football game having a chute down which a disc is slid onto the playing field upon which other discs are placed to represent players of the other team, a rolling alley, receiving mechanism variably placable in the alley and a marble that can roll down the alley.

In order to provide an improved simulated football game, this invention has been made.

SUMMARY OF THE INVENTION

BRIEF DESCRIPTION OF THE INVENTION

FIG. 1 is a perspective view of the game table of this invention with the huddle in its datum position, said view looking in a rearward direction;

FIGS. 2A and 2B together form a somewhat diagrammatic cross section longitudinal view looking in the direction of the arrow 2B—2B of FIG. 5 and 2A—2A of FIG. 23 even though FIG. 2A is taken looking in the opposite direction and a different location than FIG. 2B, said view having intermediate parts broken away and many of the structural members not being shown, and the huddle in its datum position;

FIG. 3 is a side view of the huddle release mechanism that is generally taken along the line and in the direction of the arrow 3—3 of FIG. 9 and corresponds to FIG. 2B other than it is looking in the direction of the arrows 3—3 of FIGS. 5 and 9 and the huddle is shown in its release position in dotted lines and some structure is shown that is not shown in FIG. 2B.

FIGS. 4A, 4B when taken together are a transverse, somewhat diagrammatic cross section view that is generally taken along the line and in the direction of the arrows 4A, 4B - 4A, 4B of FIG. 2A, various structural parts not being shown;

FIG. 6 is an enlarged fragmentary perspective view of a rear corner portion of the game table with the huddle in its release position and some of the defensive team members being shown on the scrimmage field for a running play;

FIG. 7 is a view of a portion of the structure shown in FIG. 6 together with a disc that in solid lines simulates one possible path of movement of an offensive player running with the football after release from the player chute and in dotted lines shows a second possible path of movement;

FIG. 11 is a fragmentary perspective view of one of the player pockets;

FIG. 14 is a somewhat diagrammatic vertical view of the marking play feed and adjacent structure that is looking in a forward direction with various structural features not being shown;

FIG. 24 is a view of one side of the player disc;

FIG. 27 is a perspective view of a defensive team member.

Figure 1:
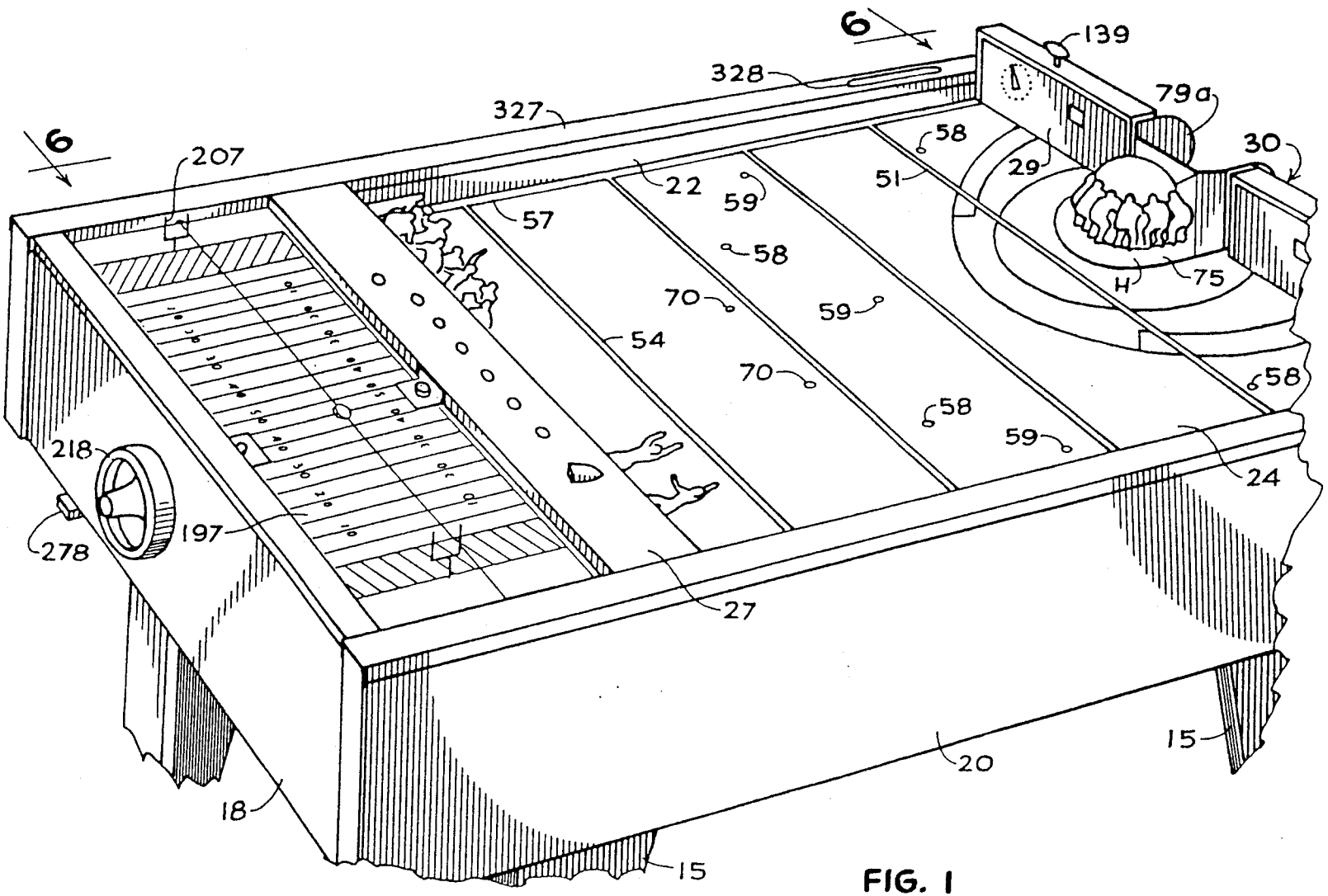

Referring now to the drawings and in particular to FIGS. 1 2A, 2B, 4A, 4B, and 23, the game of this invention has front and rear bottom frame members 11, 12, front top frame member 190, vertical front frame members 193, 194, a score board, generally designated 30 top and bottom longitudinal side frame members 191, 192 and other frame members (not shown) that are joined to one another to form a frame that is mounted by legs 15. Rear, front and side plates 17, 18, 19 and 20 respectively are mounted by the frame as is a base 21 that in part is mounted by frame members 12, 13. The base may form a part of the frame. Further a top transverse play Plate 27 is mounted by the frame longitudinally intermediate the opposite sides of the frame, but more closely adjacent to the front end than the rear end.

Figures 2A, 25, 26:
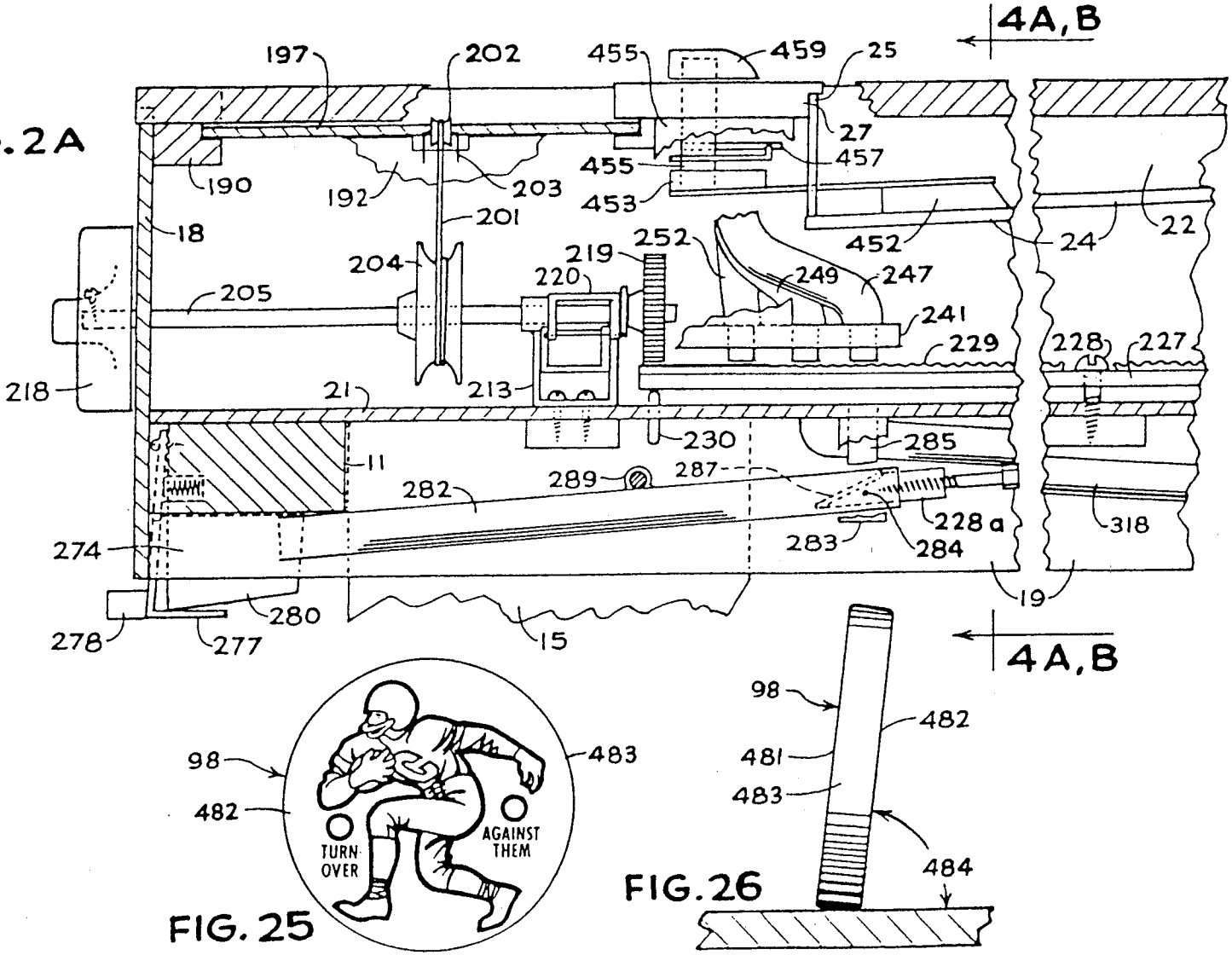
FIG. 25 is a view of the side of the player disc opposite that shown in FIG. 24.
FIG. 26 is an end view of the player disc to indicate the peripheral edge is inclined, the showing of the inclination being exaggerated.
Figure 3:
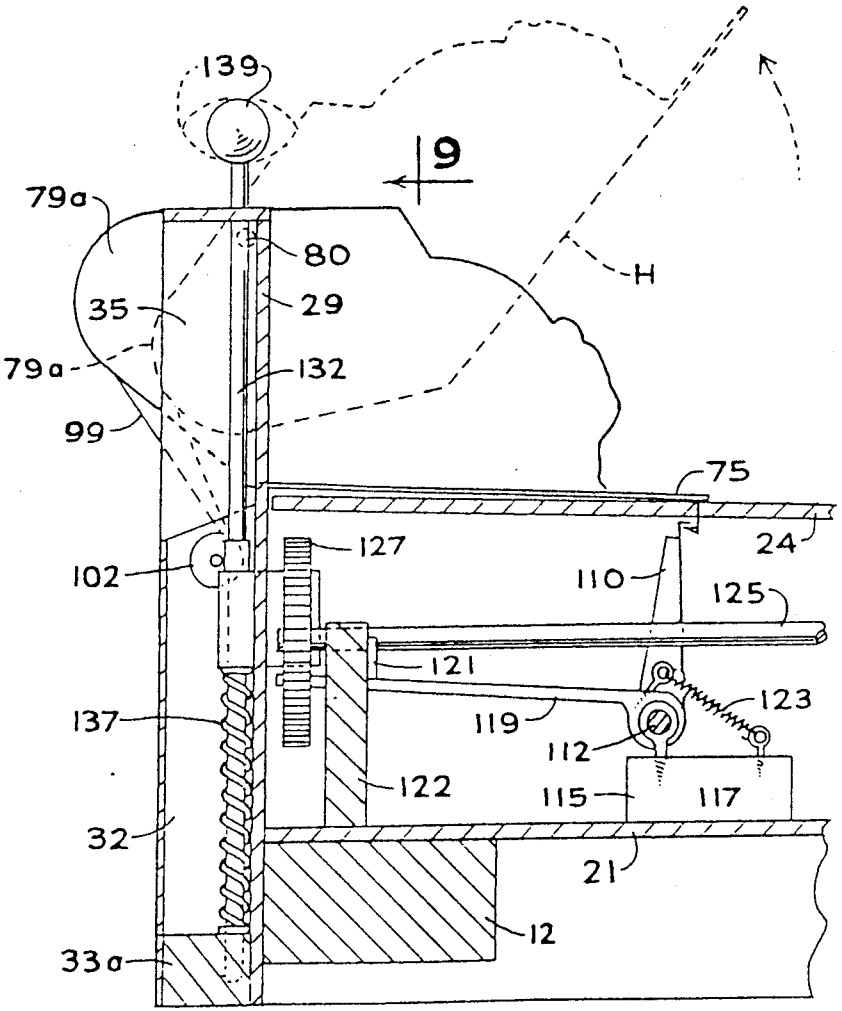
Figure 2B:
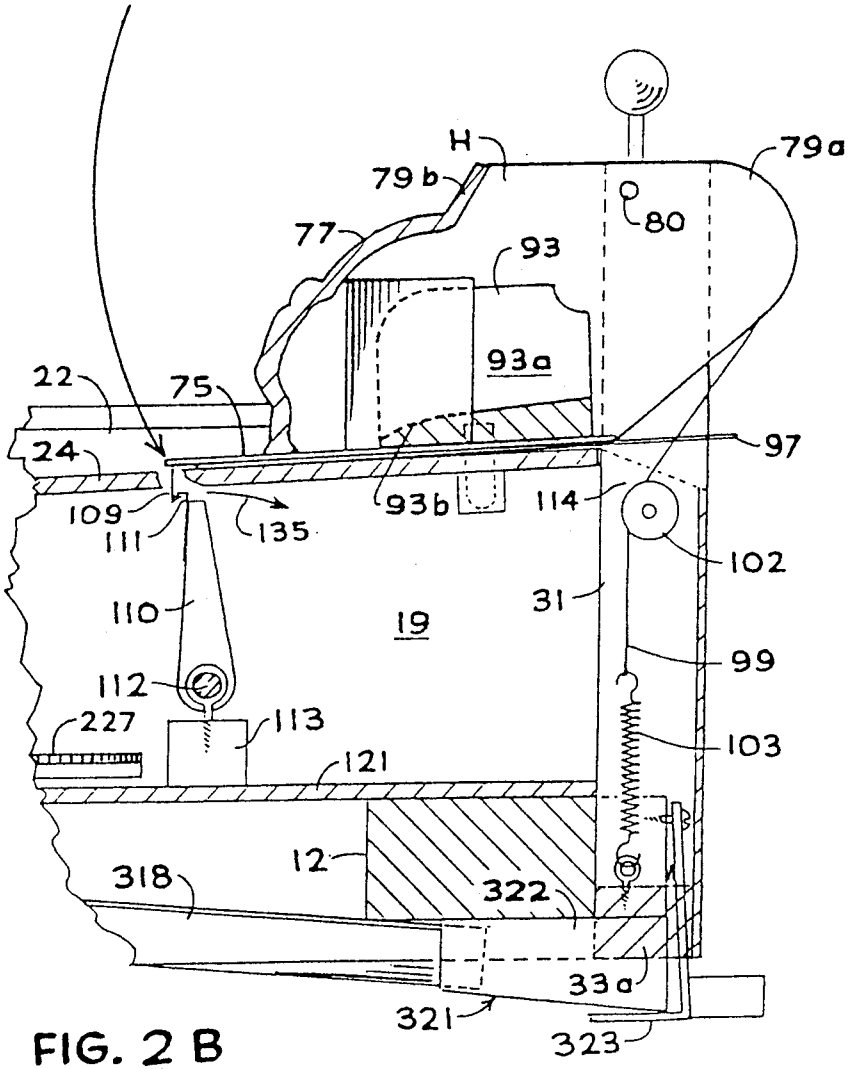
Figure 5:
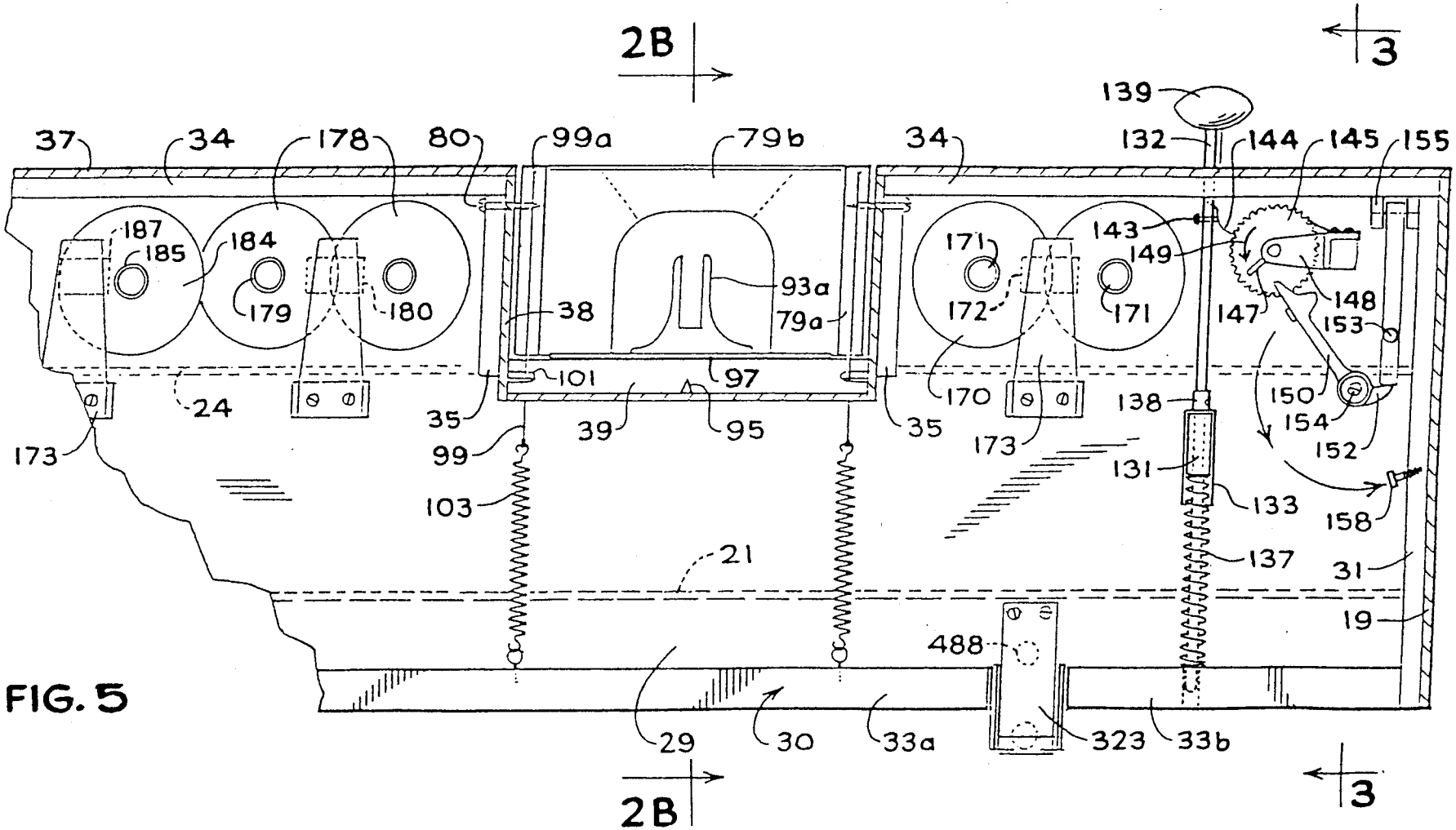
FIG. 5 is a rear end view of the score board with the rear panel removed.

Referring in particular to FIGS. 2B, 3 and 5, the score board, generally designated 30, has a front wall 29 that in part mounts the rearward end portion of the generally rectangular scrimmage field 24 while a front wall 25 dependingly mounts the forward end portion of the scrimmage field, the front wall being dependingly mounted by the plate 27. Side walls 22, 23 are mounted by the frame to abut against and extend upwardly from the scrimmage field and extend longitudinally from the wall 29 to the wall 25. The score board may form a part of the frame.

The score board also has transversely opposite side walls 31, 32, transversely spaced bottom members 33*a*, 33*b*, transversely spaced top members 34 and transversely spaced vertical members 35 dependingly joined to the adjacent ends of the top members 34 in transverse spaced relationship to one another, the members 31, 32, 32*a*, 33*b*, 34 and 35 also being joined to the score board wall 29. A transverse plate 39 is joined to the lower ends of the members 38 to be inclined downwardly in a rearward direction from the rear edge of the scrimmage field. Top transverse panels 37 are mounted by members 34.

Indicia is provided on the scrimmage field to indicate main lines 51 through 54 that include a scrimmage line 52, yard lines 55, side lines 57, an inner circle 74 and an outer circle 71 that in part defines pass pocket areas 72, 73. Further there are provided yellow pass dots 58, red dots 59 and blue pass dots 70.

Referring in particular to FIGS. 2B, 3, 6 and 10, the huddle H, which for the most part will be described as being in its datum position of FIG. 2B, includes a generally planar huddle flange 75, a huddle hood 77 extending generally vertically away from the flange and is transversely arcuately curved and representations of offensive players 78 joined to the flange and hood. A somewhat U-shaped bracket 79 is joined to the hood to have the hood open rearwardly through the web portion 79*b* while the bracket legs 79*a* extend rearwardly of the web and are pivotally attached by pivots 80 to the vertical members 38 (see FIG. 5).

Figure 10:
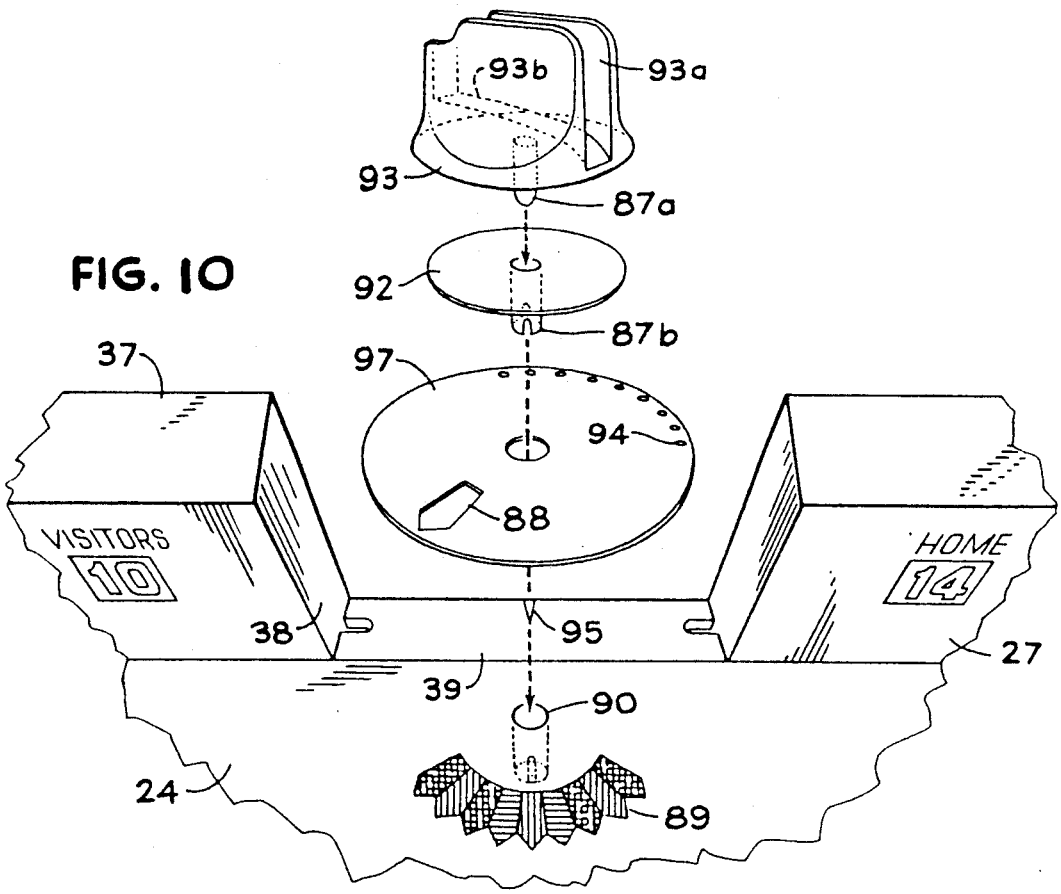
FIG. 10 is a perspective exploded view of the chute, pass selector and seat holder together with the adjacent part of the score board.

Referring to FIGS. 2B and 10, a chute 93, chute seat 92 and a pass selector 97 are pivotally mounted to the scrimmage field by pivot 87 and a seat shaft portion 87*b* of the chute seat extending into scrimmage field aperture 90 that is in transverse centered relationship to the field and a short distance forwardly of the score board. The pass selector 97 has a cut out arrow 88 that is openable to one of the plurality of colored arrow indicia 89 on the field, the two outer indicia being colored yellow, a red color being between each of the outer yellow and an adjacent yellow indicia and two blue indicia with a red indicia between the blue indicia being located between the two adjacent yellow indicia. Further the pass selector has a plurality of angularly spaced pass selector colored dots 94 generally diagrammatically opposite the arrow 88 and is rotatable such that one of the dots is radially adjacent to the pointer 95 on the inclined wall 39. The pointer 95 is transversely centered relative to the scrimmage field. When one of the dots is radially adjacent to the pointer, the slot 88 opens to one of the colored arrows 89 that is the same color as the dot that the pointer 95 points to.

The chute has a pair of vertical legs 93*a* that are spaced by a dimension slightly greater than the player disc, generally designated 98, and has a ramp surface 93*b* that is inclined in a downward direction to direct a player disc onto the rearward portion of the scrimmage field.

Referring in particular to FIGS. 2B, 3 and 5, for each of the bracket legs 79*a* there is provided a cable 99 that at its lower end is attached to the upper end of a spring 103, the opposite end of the spring being attached to the bottom score board member 33*a*. The cables extend partially around rear somewhat circular grooved edge portions of the bracket legs and are attached at 99*a* to upper parts of the bracket legs to constantly resiliently urge the bracket moving from the datum solid line position of FIG. 3 in abutting or close proximity to the scrimmage field to the release dotted line position that the selector chute can be seen from the rearward portion of the scrimmage field and the player disc 98 can roll down ramp 93*a* and unto the scrimmage field. The grooves (not shown) in the bracket leg edge portions aid in transversely retaining the cables in place. In the dotted line position, the hood blocks the view of the defense from seeing the chute and pass selector. Pulleys 102 are dependingly mounted to the inclined wall by brackets 114 to have their forwardmost portions always forward of the attachments 99*a*, regardless of the pivot position of the huddle.

To releasably retain the huddle in its datum position, a hook 109 is dependingly secured to the forward portion of the hood flange to hookingly engage the trigger 111 that is mounted by the radial outer end of the arm 110. The arm is fixed to a transverse shaft 112 which is pivotally mounted by pivot mounts 117 to block 115 that in turn is mounted by the base.

A release arm 119 has one end fixed to shaft 112 while the arm opposite end portion is abuttable against stop 121 to releasably retain the arm in its huddle datum position of FIG. 3 while a spring 123 acts between the arm 119 and block 115 to constantly resiliently urge the arms 110, 119 to their hood release position. The stop 121 is mounted by a block 122 secured to the base 21.

A longitudinal paddle shaft 125 in part is rotatably mounted by the block 122 and at its rear end portion has the toothed play gear 127 keyed thereto. A resilient stop 129 is mounted by the block 122 to permit the gear 127 to rotate in the direction of the arrow 128 while permitting the gear rotating in the opposite direction A resilient turner 130 is attached to the turner block 131 to engage the gear 127 for rotating the gear in the direction of arrow 128 when the turner block is moved downwardly but movable over the gear teeth when the turner block moves upwardly.

The turner block extends rearwardly through the rectangular slot 133 in wall 29 to be mounted by the vertical plunger shaft 132 for vertical and rotatable movement relative thereto. The turner block vertical movement is limited by at least one of the upper edges of the slot 133 and the fastener 138 that is retained in fixed adjusted positions relative to the shaft by a set screw. The plunger shaft is vertically movable in a hole that extends through bottom member 33*b* while the upper portion movably extends though holes in member 34, 37. The holes form guides while the upper end of the shaft mounts a player handle 139 in a fixed relation thereto. The plunger rod is resiliently retained in its upper position of FIG. 3 by the push spring 137 acting between the bottom member 33*b* and turner block 131 to resiliently retain the block in abutting relationship to the fastener. The downward movement of the turner block and thereby the plunger shaft is limited by abutting against the lower edge of the slot 133. When the plunger shaft is moved downwardly, it forces the release arm 119 and thereby the shaft 112 and arm 110 to rotate in the direction of the arrow 135 to release the huddle to be spring moved to the huddle release position.

Figure 9:
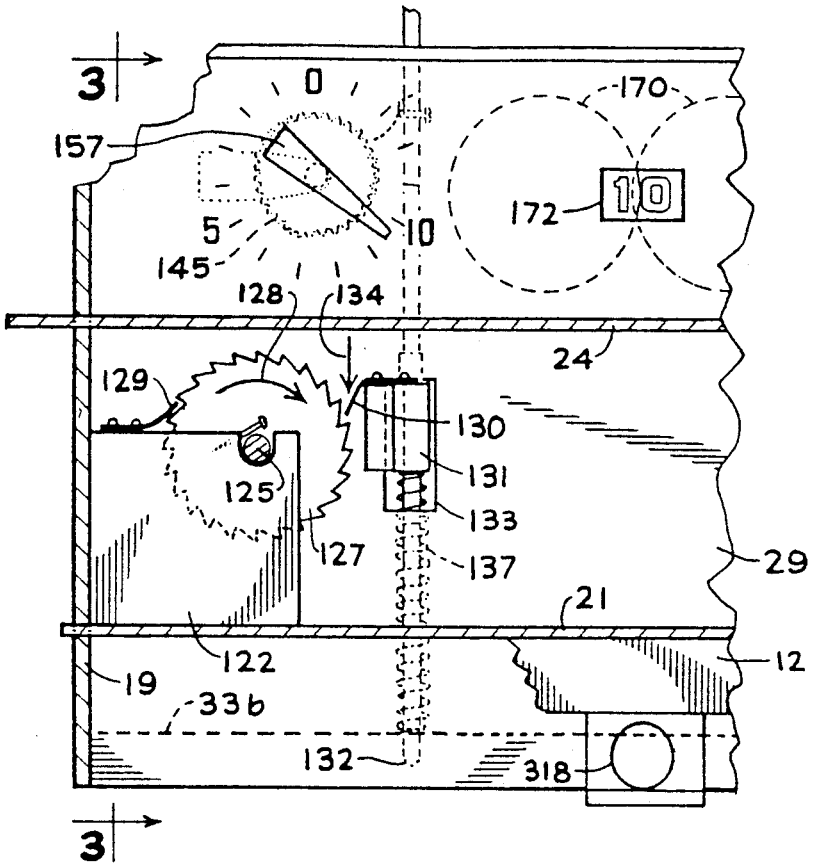
FIG. 9 is a fragmentary, somewhat diagrammatic transverse cross section view of the play gear mechanism that is looking in a rearward direction toward the score board with various structure parts not being shown.

Referring to FIGS. 5 and 9, the score board mechanism includes a fastener 143 vertically adjustably fixed to the plunger shaft for moving the turner 144 to rotate the clock gear 145 in only the direction of the arrow 149 when the shaft is vertically moved downward, i.e. rotate the gear when the shaft is moved downwardly. The gear is mounted by a bracket 148 to the score board and rotates a pointer 157. The gear has a trigger that upon each complete rotation operates the hammer 150 to move to hit the anvil and then return to its FIG. 5 position, operative mechanism including a hammer pivot 151, check 152, check button 153, transverse pivot 155 and mounting bracket dependingly mounted by member 34 for mounting pivot 155, this clock mechanism not forming a part of the invention.

When the handle 139 is in the solid line position of FIG. 3, each time the plunger handle is depressed, the game clock pointer 157 is angularly advanced one indicia segment, the length of a quarter being the number of plays required for the pointer to move one complete revolution. When the handle is rotated to the dotted line position the turner 144 is rotated such that when the handle is depressed, the turner does not rotatably engage the gear 145, but the paddle wheel shaft 125 is rotated.

Knobs 171 are mounted by the score board to mount and rotate visitor score dials 170 whereby the score can be seen through the visitor score window 172, a flexible mount 173 resiliently retaining the dials pressed against the window 172. Corresponding members 179, 178, 180, 173 are provided for keeping track of the home score. Likewise a quarter knob 185 mounted by the score board mounts and rotates the quarter dial 184 so that the quarter can be seen through the window 185 in the wall 29. The knobs are provided for manually rotating the respective dial.

Figure 12:
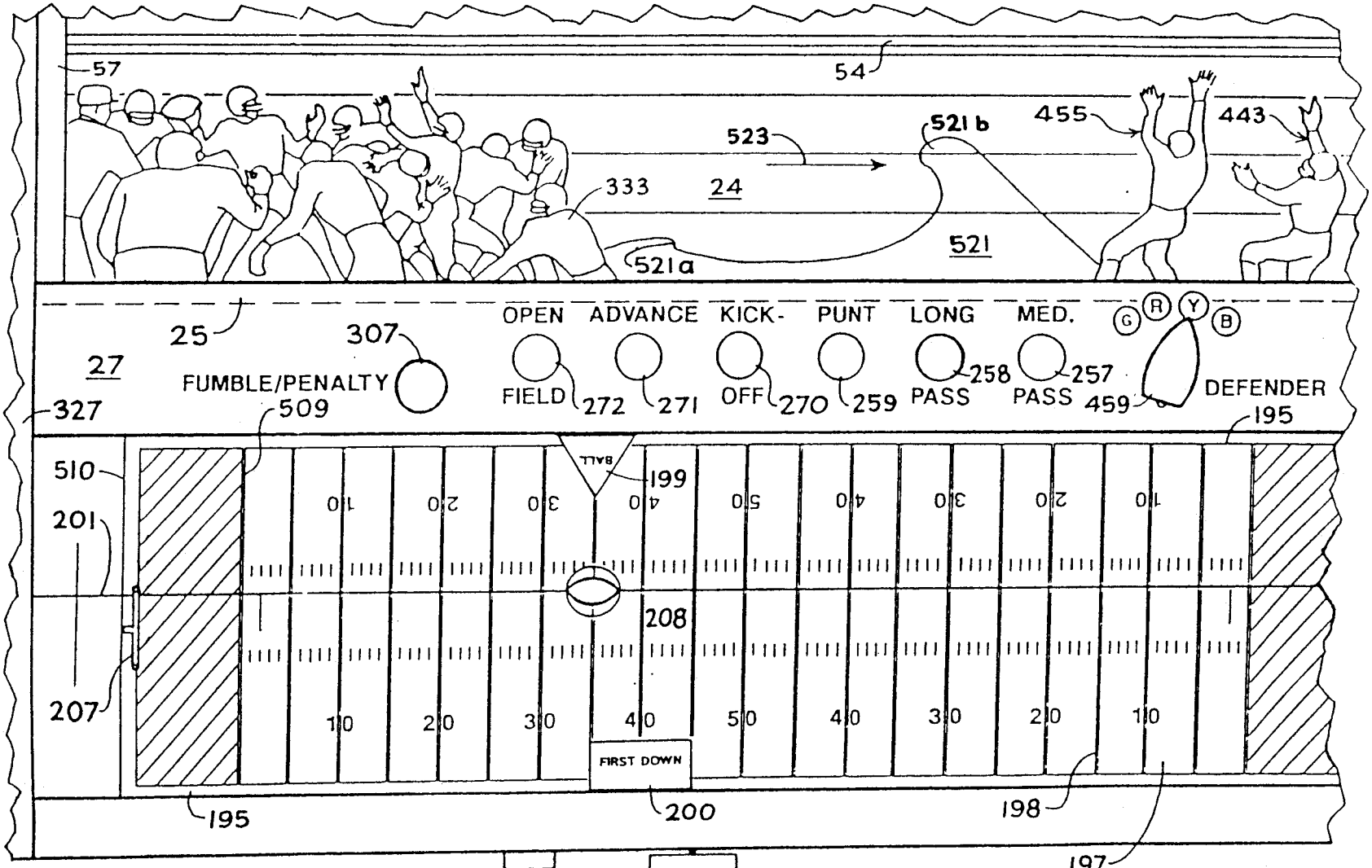
FIG. 12 is a fragmentary enlarged plan view of the marking field, play plate and rearwardly adjacent parts of the scrimmage field.

Referring to FIGS. 1, 2A and 12, the marking field 197 is mounted by mounting plate 27 and frame member 190 and has indicia 198 for indicating the yard line and side line strips 195 made of magnatizable type material. A pointer 199 is movable along the field to indicate the scrimmage line while a first down marker 200 likewise is movable to indicate the yardage required to make a "first down". Each of the first down marker and pointer 199 has a magnet (not shown) embedded therein for holding them in place along the side line and can be picked up or slid along the side line. Upright field goals 207 are mounted by the marking field.

A belt 201 is extended around small pulleys 202 mounted by brackets 203 to frame members 191, 192 to have the upper transverse belt run extend partially therearound and above and across the marking field. A ball (marker) 208 is mounted by the belt upper run to move therewith for indicating the position of the football on a football field, the belt being extended partially around the large pulley 204 that is keyed to the longitudinal marker shaft 205.

Figure 15:
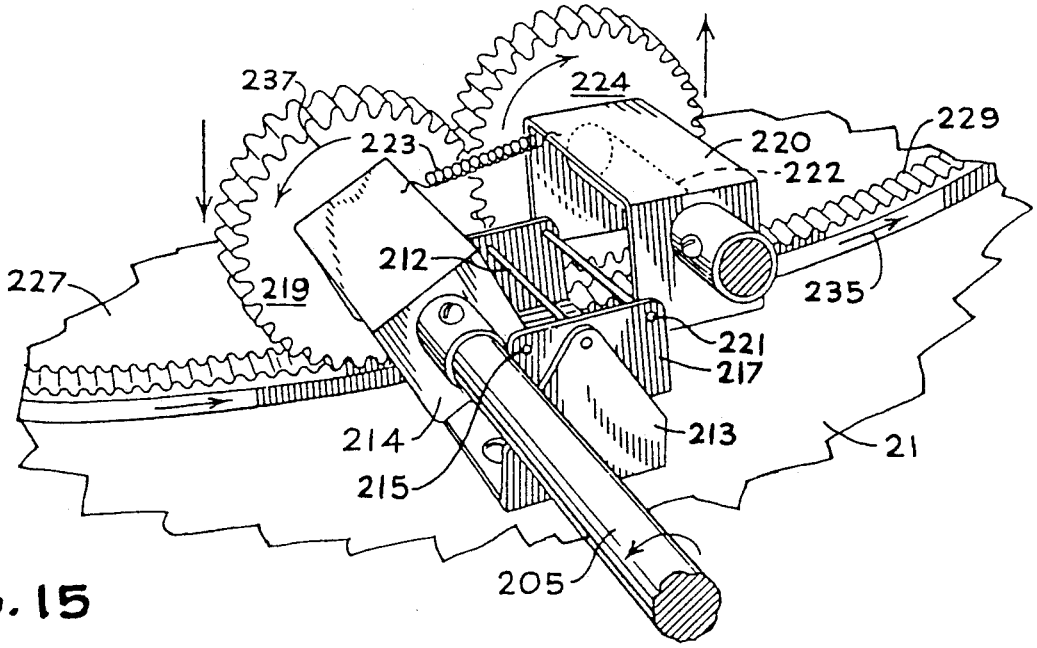
FIG. 15 is a fragmentary perspective view looking in a rearward direction of the dual gear mechanism and the adjacent part of the calculator wheel.

As may in part be seen from FIGS. 2A and 15, the marker shaft is in part mounted by front panel 18 and in part by the somewhat U-shaped bracket 214 for pivotal movement therewith. The bracket 214 has generally planar, vertical rectangular legs that each has a lower corner portion pivotally connected at 215 to the upper corner portion of the respective rectangular, transverse vertical leg of the somewhat U-shaped bracket 217. The upper transverse center portion of each leg of bracket 217 is pivotally connected by a pivot 212 to the legs of a bracket 213 that has its web mounted to base. A second bracket 220 that is of the same size and shape as bracket 212 has the lower corner portions of its legs pivotally mounted at 221 to the upper corners of the legs of bracket 217 transversely opposite the corner portions of the legs of bracket 217 that mount pivot 215. The central portions of the legs of bracket 214 mount the shaft 205 to rotate relative thereto and pivot therewith while the central portions of the legs of bracket 220 likewise rotatably and pivotally mount a stud shaft 222 in parallel relationship to shaft 205. The shafts 205, 222 have toothed gears (dual gear) 223, 224 respectively keyed thereto with the gear teeth in intermeshing relationship. The transversely adjacent corner portions of the brackets 214, 220 are pivotally connected to the bracket 217 while a spring 223 has its opposite ends connected to the adjacent upper longitudinal edge portions of the brackets to resiliently urge the brackets to pivot toward one another. The radial spacing of the shafts from one another is limited by the gears being in intermeshing relationship, the spring acting to retain the gears in such relationship.

A circular, generally planar calculator wheel 227 is rotatably mounted by a vertical pivot member 228 to the base 21, the outer peripheral edge portion of the wheel mounts an annular toothed track 229 to the teeth extend thereabove to have its teeth in driven relationship with one of the gears 219, 224. A plurality of angularly spaced rollers 230 are extended through cut outs in the base to support the outer peripheral edge portion of the calculator wheel, the rollers being mounted by the base. The gear that drives the wheel depends upon the direction of rotation of the shaft 205, there being a marking wheel 218 keyed to the shaft 205 axially opposite gear 219 for rotating the shaft. If the gear 219 is rotated in the direction of arrow 237 it results in the gear 219 rotating the calculator wheel 227 in the direction of the arrow 235 while gear 219 drives the gear 224 in the opposite angular direction and results in gear 224 moving upwardly relative to the track and out of driving relationship to the track, if in such a position, to the FIG. 15 position. If the marker wheel is rotated in the direction opposite arrow 237 and the dual gears 219, 224 are in the position shown in FIG. 15, the initial rotation of the marker shaft acts to lower the gear 224 and upon gear 224 drivingly engaging the track, the gear 219 raises up on the gear 224 to be elevated out of the driving relationship to the track whereby the track is rotated in the direction of arrow 235.

Figure 13:
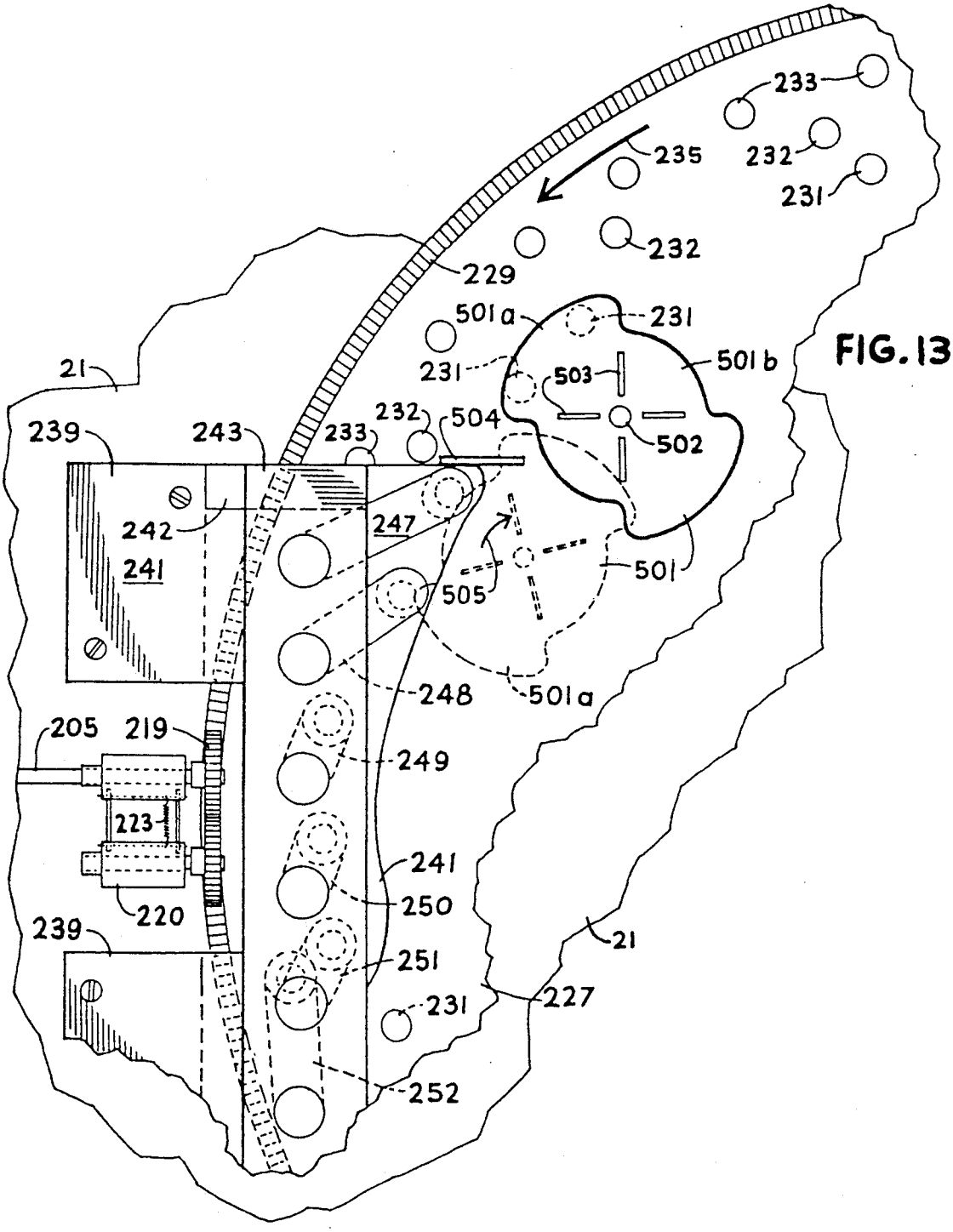
FIG. 13 is a somewhat diagrammatic, fragmentary plan view taken at a lower elevation than the play plate to show portions of the calculator wheel, dual gear and the marking play feed; various structural features not being shown.

Referring to FIG. 13, the calculator wheel is provided with a plurality of outer apertures (outer ring of apertures) 233 that are equally radially spaced from the wheel pivot 228, a second plurality of apertures (intermediate ring of apertures) 232 and a third plurality of apertures (inner ring of apertures) 231, each of these apertures extending vertically through the wheel 227 to open to the base and being of the same diameter. It is noted that the apertures 233 may be equally angularly spaced from one another or advantageously unequally spaced from one another such as shown in FIG. 13 for the inner and intermediate rings. In either event it is preferred that at least the average spacing of the angularly adjacent apertures in each ring is such that on the average the apertures 231 in the inner ring are more closely angular adjacent to one another than the apertures in each of the other rings while the angular spacing of the adjacent apertures 232 is at least on the average much greater than the average angular spacing of the apertures in each of the other rings.

Referring to FIG. 13, an alternator 501 is pivotally mounted at 502 to the rack wheel 227 to pivot about a vertical axis much more closely adjacent to the inner circle of apertures 231 than the calculator wheel pivot axis. The alternator has horizontally (diametrically) opposite circular portions 501*a*, and diametrically opposite arcuate sections 501*b* that advantageously are of the same radii of curvature as sections 501*a*. Sections 501*b* are offset from sections 501*a* by 90° and are located more closely adjacent to the axis of the pivot 502 than sections 501*a*. Four arms 503 extend upwardly from the alternator and are at right angles relative to one another, the arms extending to a higher elevation than the turner 504. The turner is mounted by the plate 241 of the marking play feed that will be described below. The turner acts to engage one of the arms 503 for turning the alternator one-quarter of a turn as the alternator is moved angularly past the turner by rotation of the calculator wheel. Two of the apertures 231 are of a spacing such that in the solid line position of the alternator in FIG. 13, one of the sections 501*a* is in overhanging relationship to the said two apertures 231, but when the calculator wheel has been sufficiently rotated, the alternator is turned one-quarter of a turn from the solid line position to the dotted line position wherein none of the alternator is in overhanging relationship to any of the apertures 231. Thus for every complete revolution of the calculator wheel, the alternator is rotated one-quarter of a turn about the axis of pivot 502. When the said two apertures 231 are covered by alternator portion 501*a* and the bearing drops there onto, the bearing remains thereon until the wheel has been rotated so that the bearing drops off the alternator and remains on the wheel until the trailing aperture (one in the direction opposite of arrow 235) moves under the bearing. By the time the wheel is rotated for the bearing to drop into the said trailing aperture the marker 208 can be moved to represent, for example 108 yards.

Referring in particular to FIGS. 2A, 4A, 4B, 13 and 14, the marking field feed, generally designated 238, is mounted to at least in part be in overhanging relationship to the rings of the apertures in the calculator wheel. The feed 238 includes an open, general rectangular feed frame that includes transversely spaced, vertical side bars 242, a lower plate 241, and an upper plate 243, the upper plate being directly beneath the play plate 27. Portions of the lower plate being mounted to the mounting blocks 239 such that the plate 241 is at a higher elevation than the track, the blocks 239 being mounted to the base and forwardly of the track.

A plurality of feed tubes 247–252 have their upper ends opening through the upper bar 243 to open directly to the apertures 272, 271, 270, 259, 258 and 257 respectively (also see FIG. 12). The lower ends of the tubes 247, 248 open through the plate 241 and are of equal radial spacing from the wheel pivot 228 and of the same radial spacing from the axis 228 as apertures 232, the lower ends of tubes 249, 250, 251 opening through plate 241 and are of equal radial spacing from the Wheel pivot as the apertures 232 and the lower end of tube 252 opening through the plate and being of equal radial spacing from the wheel pivot as the apertures 233. As may in part be seen from FIGS. 4B and 13, the lower edges of the tubes 247, 248 are at a slightly higher elevation than the top surface of the alternator to prevent a metal bearing 279 in one of these tubes dropping into one of the apertures 231 until the marking wheel has been rotated sufficiently to move the marker 208 the length of the marking field. That is, with the alternator in its blocking position and the calculator being rotated in the direction of the arrow 235, an arm 503 engages the turner 504 and a portion 501*a* is rotated to be out of underlying relationship to the lower ends of edges of tubes 247, 248.

Figure 4A:
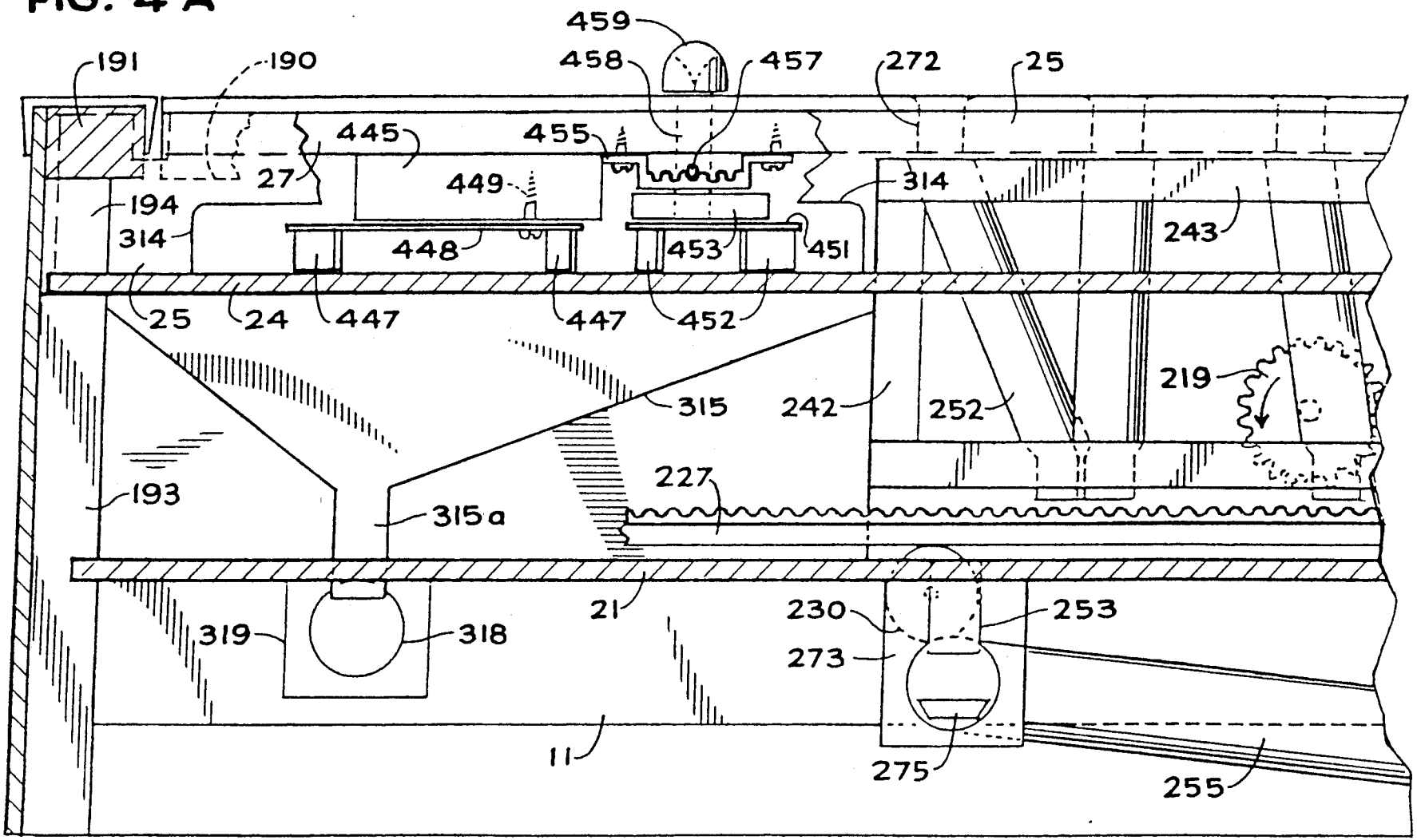
Figure 21:
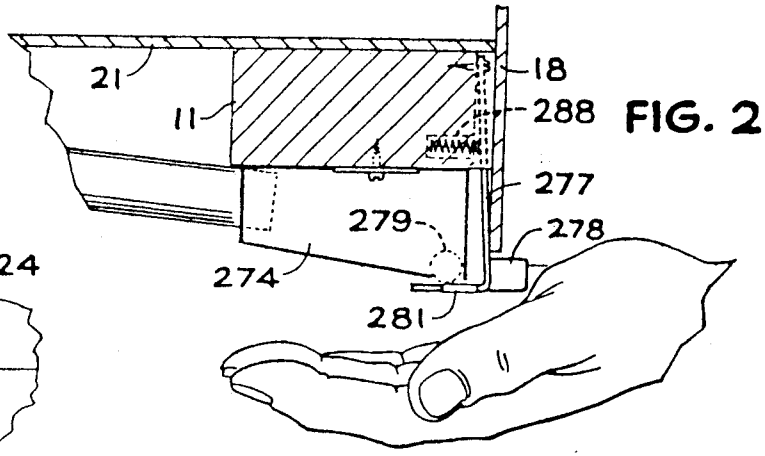
FIG. 21 is a fragmentary side view of one of the dispensers, part in cross section, with the side panels and side frame members not being shown, and various other adjacent structural features not being shown.

Referring to FIGS. 2A, 4A, the base dependingly mounts drop tubes 253, 254 that open through the calculator wheel and are of the same radial spacing from the calculator pivot axis as the apertures 232, 233 respectively. The drop tubes open to the forward end portion of the pass and kick return tube 255 which extends downwardly in a forward direction to have its front end open into the dispenser receptacle 274 of the dispenser, generally designated 280 (also see FIG. 21), the rear end of the tube 255 being dependingly mounted to the base by the mount 273. A click plate 275 is mounted within the return tube 255 to be directly beneath the drop tubes 253, 254, the click plate being made of metal that will give off a clicking sound when a bearing drops through the drop tube and thereonto The dispenser receptacle is dependingly mounted by the frame member 11 and is sloped forwardly and to one side to have a bearing 279 when therein roll to be directly above horizontal leg of the right angle opener bar 277. The vertical leg of the opener has its upper end attached to the frame member 11. A release button 278 is secured to the opener to push the horizontal leg rearwardly from the closed position of FIG. 2A to an open position. The horizontal leg has an aperture 281 extended therethrough that when the release button is pushed forwardly the bearing in the receptacle moves through an aperture in the receptacle bottom wall and through the aperture 281. A spring 288 is located in a hole in the frame member 11 and abuts against the vertical leg of the opener for constantly resiliently urging the opener to a position that aperture 281 is out of alignment with the aperture in the receptacle bottom wall whereby the bearing in the receptacle remains therein.

Also opening to the dispenser receptacle is the front end of the pivotal return tube 282, a drop tube 285 being dependingly mounted by the base to be of the same radial spacing from the calculator wheel axis as the apertures 231 to open through the base to the rear end portion of the return tube 282. A transverse pivot 284 is located longitudinally adjacent the drop tube 285 and forwardly of the drop tube to pivotally mount the return tube 282, pivot 284 being dependingly mounted by ears 283 from the base. Rearwardly of pivot 284 a ring 289 is fixed to the return tube 282 to have a transverse gate arm 290 slidably extended therethrough.

Figure 22:
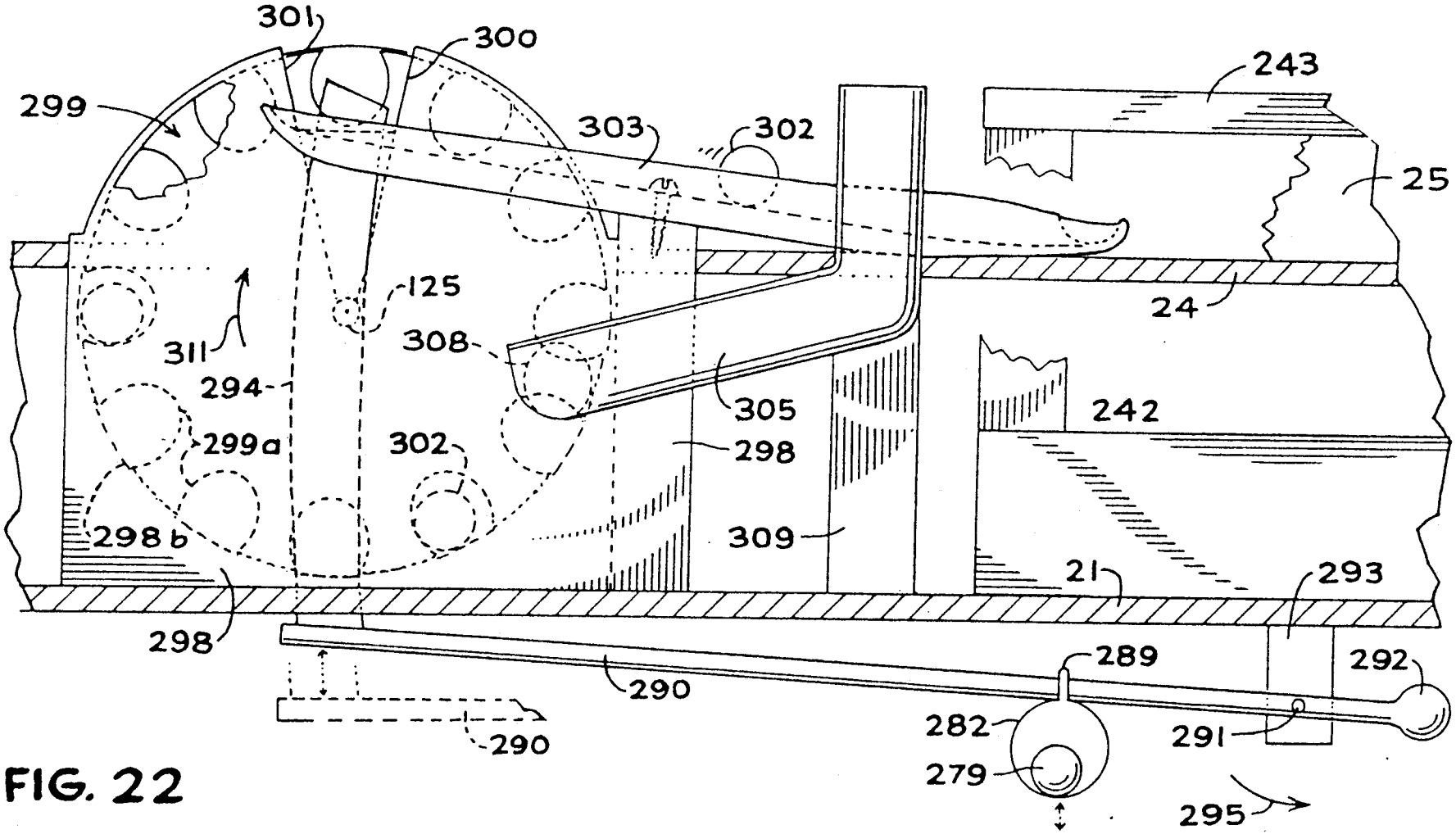
FIG. 22 is a somewhat diagrammatic transverse cross section view of the structure of FIG. 20 that is generally taken along the line and in the direction of the arrows 22—22 of FIG. 20 with various adjacent structural features not being shown.

A counterweight 282*a* rearwardly of pivot 284 is joined to the rear end of the tube 282, a screw being threaded into the counterweight to extend rearwardly of the counterweight to provide an adjustment of the force urging the front end of tube 82 to pivot upwardly. A counterweight 292 is joined to one end of the arm 290 while the end of the arm 290 opposite the ring mounts a gate 294 to extend thereabove. Ears 293 depending from the base mount a longitudinal pivot 291 that in turn mounts the gate arm intermediate the counterweight 292 and the return tube 282. When a bearing 279 is dropped into the return tube 282 the arm 290 pivots in the direction of arrow 295 to lower the gate but after the bearing rolls down the return tube forwardly of the pivot 291, the counterweight 292 results in the arm 290 pivoting in the opposite direction to raise gate. An appropriate slot is provided in the rear wall of the dispenser receptacle 274 to permit the above movement of the gate between the gate lowered dotted line position of FIG. 22 and the raised solid line position of said Figure.

Paddle wheel front and rear mounting walls 298 are in part mounted in fixed positions by the base to extend above the base and have the paddle wheel shaft 125 extend through one of the walls 298 for having the paddle wheel, generally designated 299, keyed thereto between the walls. A plurality of angularly spaced, arcuately curved longitudinal pockets 299*a* open transversely through the paddle wheel and to the front and rear walls 298. The front wall 298 has a pie shaped slot 300 while the opposite wall 29B has an aperture 301, the aperture and slot 300 permitting a marble (rollable round game element) 302 to roll out of the pocket when the respective pocket is adjacent its uppermost elevation during the rotation of the paddle wheel. The marble can roll out through the slot 300 only when the gate is adjacent its lowered elevation.

A fumble and penalty marble hole 307 in the plate 27 opens directly to the upper end of the fumble return turn tube 305 that at least in part is mounted by the mount 309 to the base 21. The lower portion of the tube 305 is downwardly inclined and opens through an aperture 308 in one of the front and rear walls 298 in a position for a marble 302 to roll into a pocket 299*a* when a paddle wheel has been rotated in the direction of arrow 311 sufficiently for a marble 302 in a pocket to roll outwardly through the slot 300 or the aperture 301, the marble will roll into the upper end of the ramp chute 303 that extends along the paddle wheel front and rear walls. The chute is forwardly and downwardly inclined. The one of the pie slot and aperture 301 through which the marble rolls in rolling from a pocket 299*a* to the trough depends upon the longitudinal direction that the pocket is sloped. It are noted that some of the pockets are inclined (sloped) in one longitudinal direction and some in the other. In playing the game there are provided, for example 2 red marbles in the pockets and 2 yellow marbles in the pockets, i.e. there being many more pockets than marbles. As an example, but not as a limitation on the invention, the plunger may have to be depressed 20 times in order for one pocket to be rotated through 360°.

Figure 20:
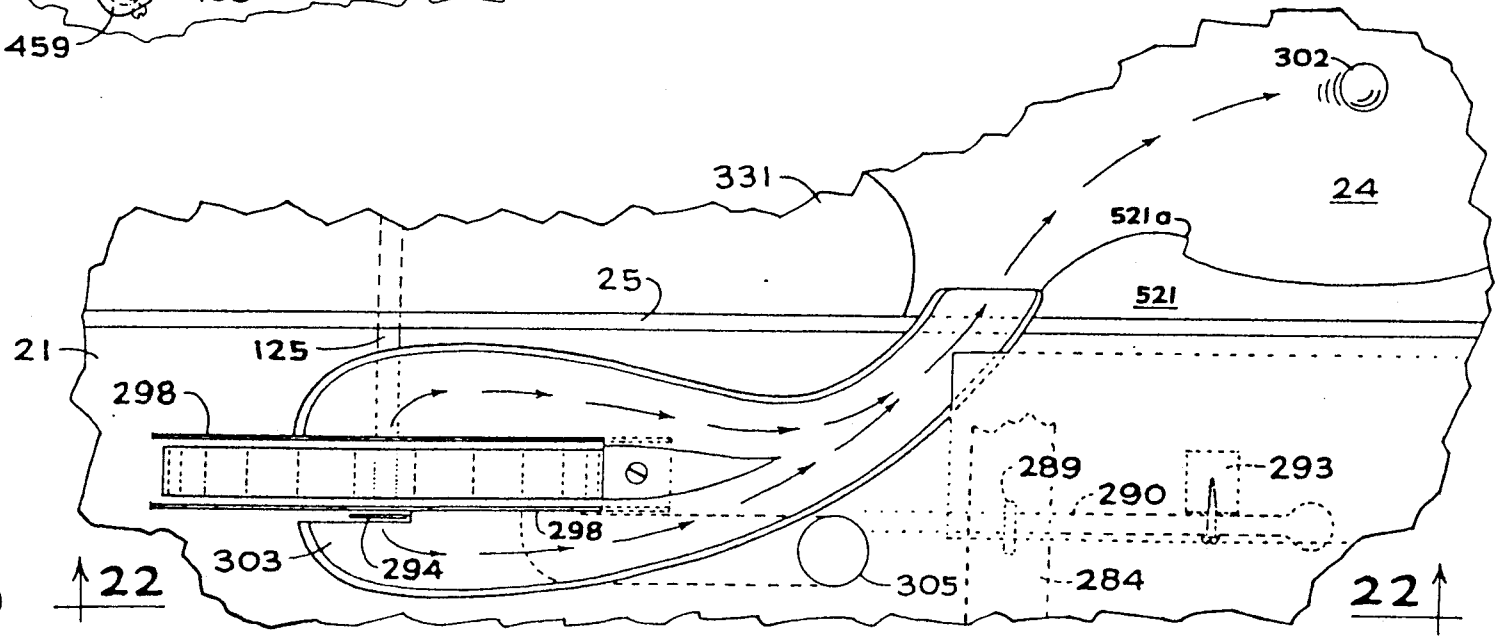
FIG. 20 is a fragmentary plan view of the paddle wheel and adjacent structure with the play plate removed and various structural features not being shown.

The lower, longitudinal forward end portion of the chute extends through an opening 304 in the wall 25 for discharging a bearing onto the scrimmage field to roll rearwardly and transverse toward the frame member 190 and thereafter, due to the inclination of the scrimmage field forwardly toward wall 25. A receptor 521 (see FIGS. 8, 12, 20) is mounted to the scrimmage field transversely between the discharge end of the chute 303 and the transversely elongated opening 314 in the wall 25. The receptor is in the form of a generally horizontal plate that extends sufficiently above the scrimmage field to prevent a marble to roll over it. The receptor abuts against the wall 25 and in a transverse direction (arrow 523) from the chute 303 toward the opening 314 is arcuately curved to first extend rearwardly and toward the opening 314, thence predominately transverse in the direction of the arrow 523 to a relatively sharp bend 521*a*, next a short distance nearly entirely rearwardly, then through a transversely elongated section that extends progressively a short distance forwardly, next progressively more sharply rearwardly, thence predominantly rearwardly and transversely opposite arrow 523 (reversely curved), next slightly in the direction in the arrow 523 and rearwardly to form an arcuately curved portion 521*b*, and thereafter inclined in a direction forwardly and in the direction of the arrow 523 to the adjacent vertical edge of the opening 314 that is mostly to the chute 303. As may be noted from FIGS. 12 and 20, the rearwardmost part of part 521*a* is a substantial distance rearwardly of the discharge end of chute 303 and substantially more transversely closely adjacent to the chute than part 521*b*. Additionally the rearwardmost part of portion 521 extends a substantial distance further rearwardly than the rearwardmost part of part 521*a*. Due to the height and slope of the chute 303, the slope of the scrimmage field and the curvature of the rear edge of the receptor, substantially all the time a marble rolls down the chute 303, it is trapped in the rearwardly cup shaped portion of the receptor extending between the rearwardmost parts of the parts 521*a*, 521*b*; however, the receptor does not extend sufficiently rearwardly of the wall 25 to preclude the bearing 279 rolling transversely across the scrimmage field to the opening 314 as will be described below.

Figure 19:
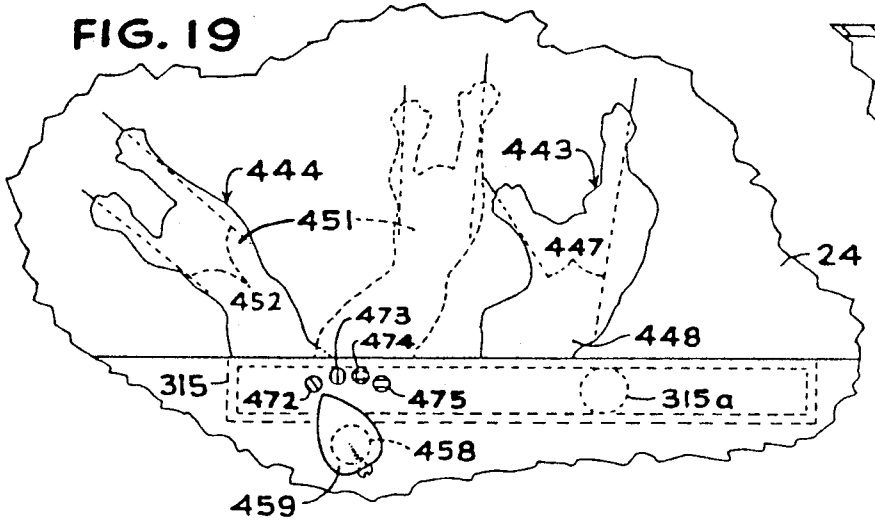
FIG. 19 is a fragmentary plan view of the pass receiver and defender mechanism with various structural features not being shown, the defender being shown in solid lines in one position and a second adjusted positions in dotted lines.

In the event a marble is not trapped by the receptor, or a bearing 279 rolls adjacent to opening 314, the bearing or marble rolls through the opening and then rolls off the edge of the scrimmage field and into the pass return trough 315 that is dependingly mounted on the scrimmage field (see FIGS. 4A and 19). The lower end of the trough narrows to be of tubular shape and discharge into the upper forward end portion of the pass return tube 318 that in part is dependingly mounted to the base by a mount 319. The rearward end of the return tube 318 is mounted by and opens to the dispenser receptacle 322 of the dispenser, generally designated 321 (see FIG. 2B). The dispenser receptacle is dependingly mounted from the frame member 12 while the frame member mounts a release and opener member 323 that is of the same construction as that described with reference to FIG. 21 and is operated in the same manner.

Passing play structure includes an elongated slot 328 in the rearward end portion of the longitudinal top panel strip 327, the slot opening to the rear end portion of the tunnel groove 329 in the frame 192 and thence through the chute 339 in a member 192 that is transversely between panel 19 and the wall 22 and thereafter onto the scrimmage field in a tunnel formed by member 327, the scrimmage field, the panel 19 and member 22. The rear portion of the slot has a dip portion 328*a* for storing a bearing 279 (rollable round element) whereby the bearing has to be moved slightly upwardly before moving downwardly and torwardly through the tunnel 329. The forward end of the tunnel opens, through the side wall 22 and along the scrimmage field to have the bearing roll along the rear vertical surface portion 331*a* of the mount 331 that initially curves forwardly and predominantly transversely and thence rearwardly and predominantly transversely along the forward end portion of the scrimmage field.

A deflector block 334 is mounted by the mount 331 for adjustably varying the path 337 of the bearing after the bearing has exited from the pass tunnel 329. The block is retained in a selected adjusted position relative to the mount within the cut out by a screw with a space being between the longitudinal edge of the block adjacent to the screw and the mount. The block extends within the cut out with a transverse space being between the front edge of the block and the adjacent transverse edge of the cut out. The longitudinal edge of the block opposite the screw is fixed to a longitudinally elongated rubber strip 335, the forward end portion of the strip being fixedly mounted in a slit in the mount that extends forwardly of the cut out. The mount 331 is mounted on the scrimmage field at the forward end thereof and in part being beneath the frame member 192.

Figure 18:
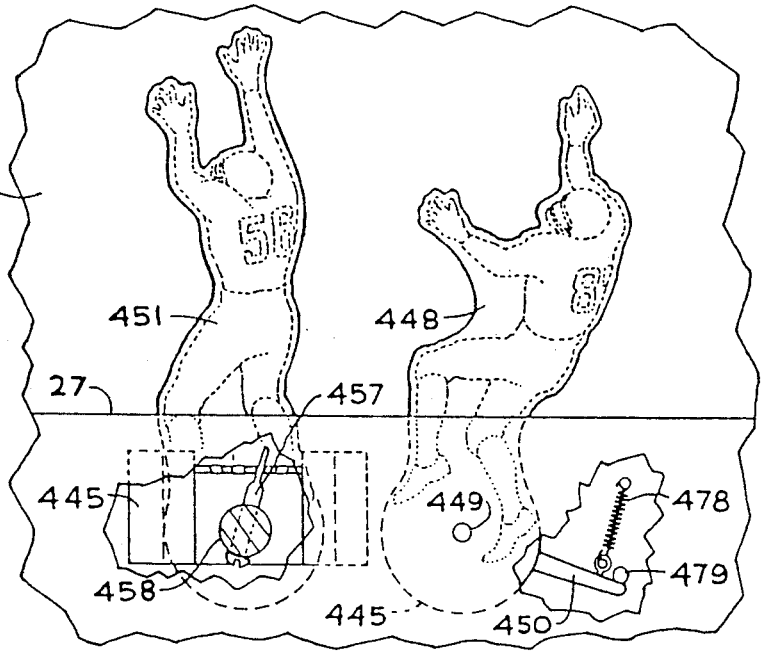
FIG. 18 is a fragmentary plan view for showing the pass receiver and defender mechanism with parts of the transverse play plate broken away and various structural features not being shown.
Figure 23:
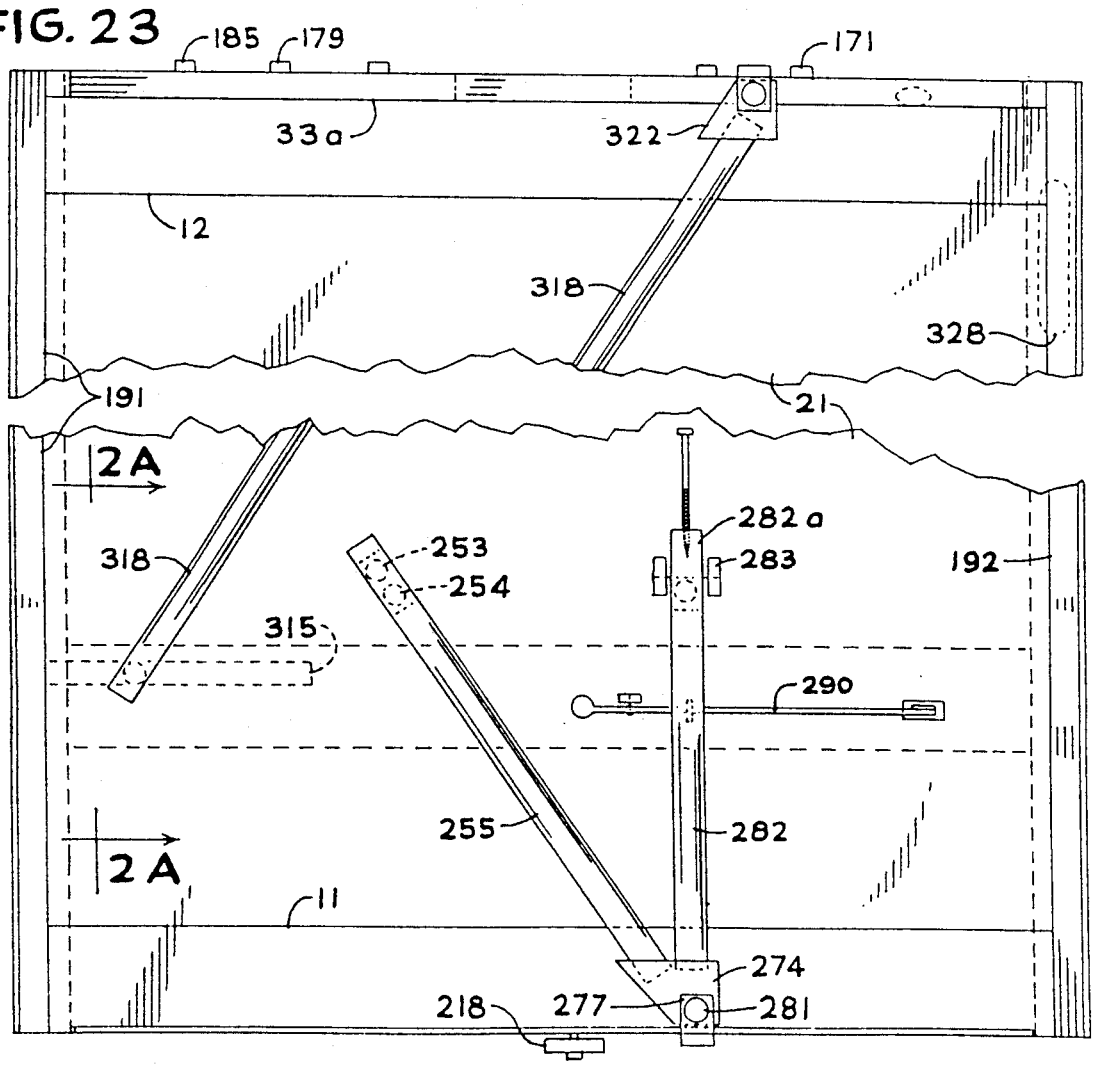
FIG. 23 is a bottom view to illustrate the return tubes, the legs not being shown and the longitudinally intermediate part being broken away.

After the bearing on the scrimmage field stops moving rearwardly, due to the scrimmage field inclination, it rolls toward the opening 314. To ascertain whether or not a pass has been intercepted or received, there is provided a pass receiver mechanism and pass defender mechanism, generally designated 443 and 444 respectively (see FIGS. 4A, 18 and 19). The receiver mechanism 443 includes a generally planar depiction of a pass receiver 448 that extends planar to the scrimmage field and vertically spaced thereabove to permit a bearing moving toward the opening 314 pass therebeneath, the receiver being depending mounted from the plate 27 by mount 445 which is pivotally attached to the plate 27 by a vertical pivot 449. An arm 450 extends radially outwardly from the mount 445 and is spring urged to the datum limit position of FIG. 18 by a spring 478 to abut against a stop 479 which is dependingly mounted to the plate 27. Dependingly mounted by the receiver are a pair of generally longitudinally elongated, transversely spaced cleats 447 that extend to the scrimmage field. The cleat that is most remote from the discharge end of the tunnel 339 extends further rearwardly than the other cleat. If the bearing in moving toward the opening 314 rolls between the cleats 447, the pass is considered received (completed). If the bearing strikes the right hand cleat 447 transversely between the cleats 447, the spring 478 permits the receiver to pivot in a clockwise direction as viewed in FIG. 18 to minimize the chance of the bearing bouncing off the right hand cleat with sufficient force that the bearing would not roll downwardly between the cleats 447. The spring 478 is a relatively weak spring.

The defender 444 includes a pass defender 451 in the form of planar depiction similar to player 447 and dependingly mounts a pair of spaced cleats 452 to abut against the scrimmage field. The pass defender is dependingly mounted from the dial shaft 458 and pivots about a vertical axis by a mount 453. The shaft extends upwardly through the plate 27 and at its upper end has a coverage dial 459 mounted thereon for pivoting the shaft. Below the plate 27 the shaft mounts a setter 457 to extend radially for extending into one of the four toothed notches in the bracket 455 that is dependingly mounted to the play plate 27. There is a color indicia for each tooth notch for each notch, for example green, red, yellow and blue that are designated 472–475 respectively, the notch that the setter extends into being indicated by the apex portion of the dial.

When the dial points to the indicia 472, the pass defender is in the solid position of FIG. 19 and when to the indicia 475, the dotted line position of the same Figure. At the time the dial is pointing to the indicia 473, the pass defender is in the position illustrated in FIG. 12 with the cleats 452 extending forwardly of and more closely adjacent to the rear opening between the cleats 447 as may be seen from FIG. 19 and thereby the greatest chance of preventing a pass being received by the pass receiver. In any one of the pass defender positions, when the bearing in moving toward to opening 314 rolls between the cleats 452, the pass is considered to be intercepted. In the event the bearing rolls through the opening without first rolling between cleats 452, or cleats 447, the pass is considered not to have been received or intercepted. It is noted that at all times the pass defender and pass receiver extend beneath the play plate 27 and have their respective cleats being entirely longitudinal rearwardly of the play plate 27. In the event the bearing comes to rest against the wall 25, then it is considered that the pass is incomplete.

Figure 8:
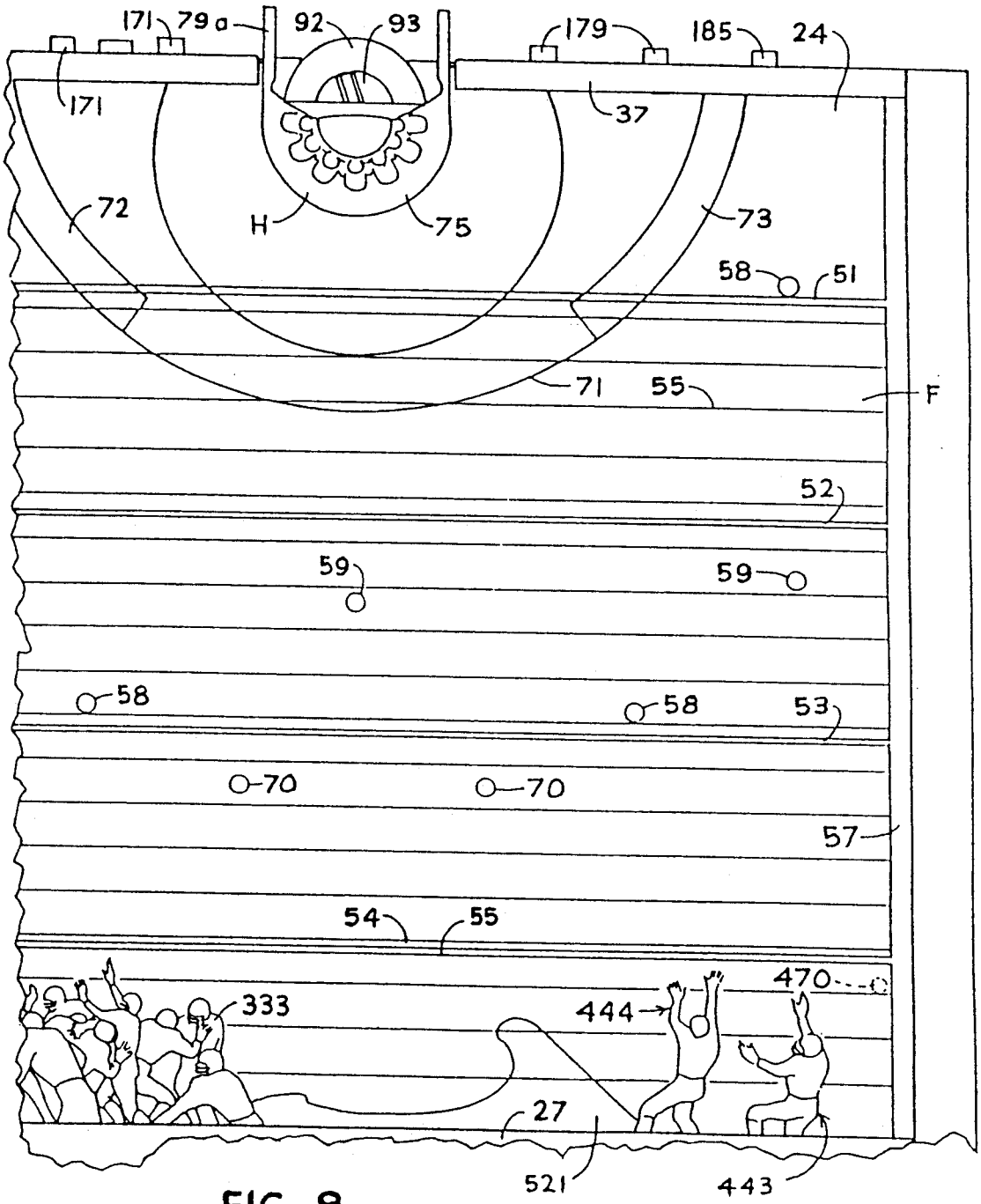
FIG. 8 is a partial plan view of the scrimmage field showing the pass dots for various defensive team members relative to the scrimmage field and the proposed length of pass.

As may be seen from FIG. 8, a short distance rearwardly and to the right of the right hand of the receiver 443, a magnet 470 is mounted on the underside of the scrimmage field. If a bearing rolls closely adjacent to the magnet, the magnet stops (magnetically traps) the bearing, and in such an event, there is considered to be pass interference by the pass defender.

Figure 4B:
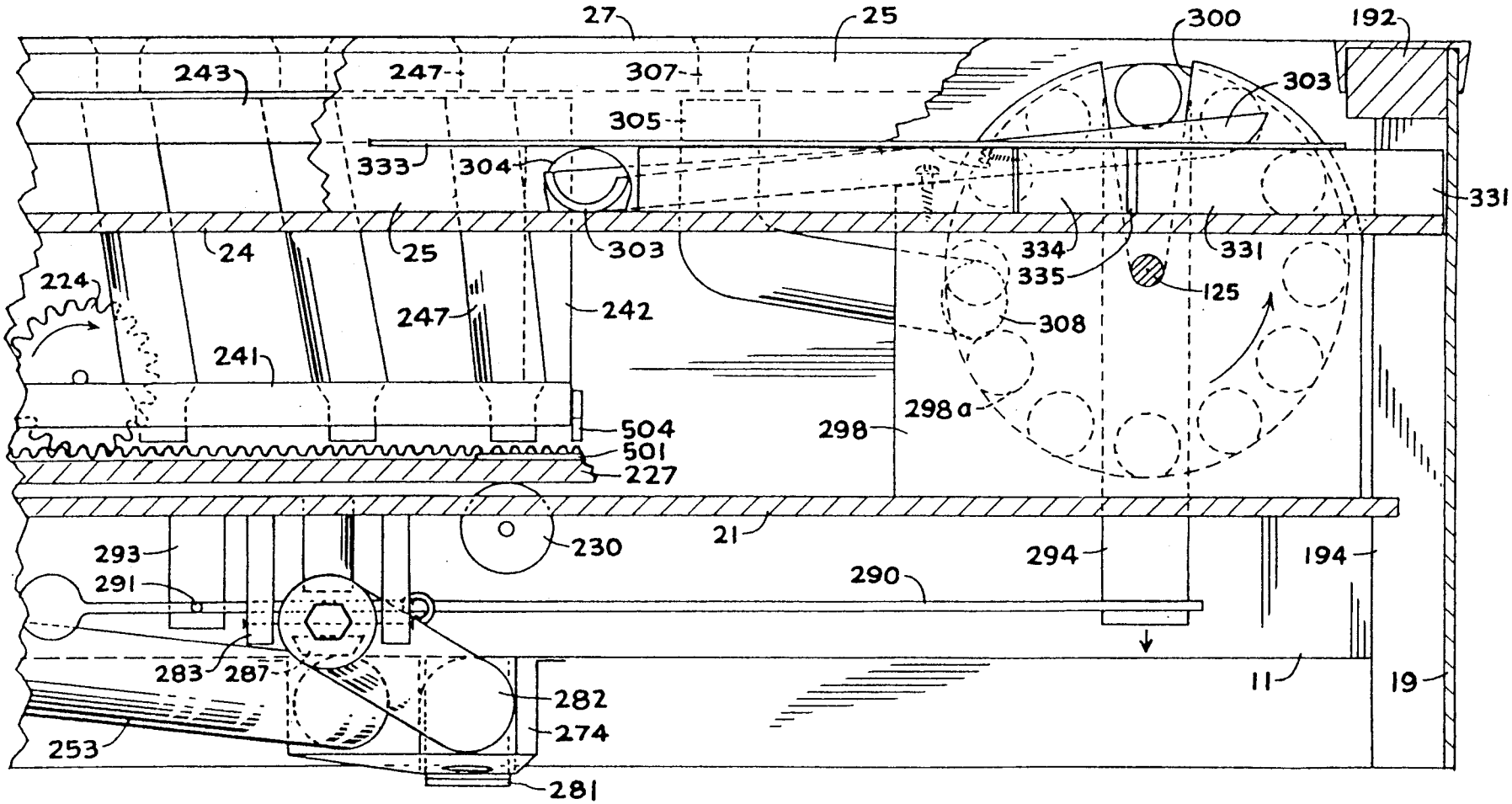
Figure 17:
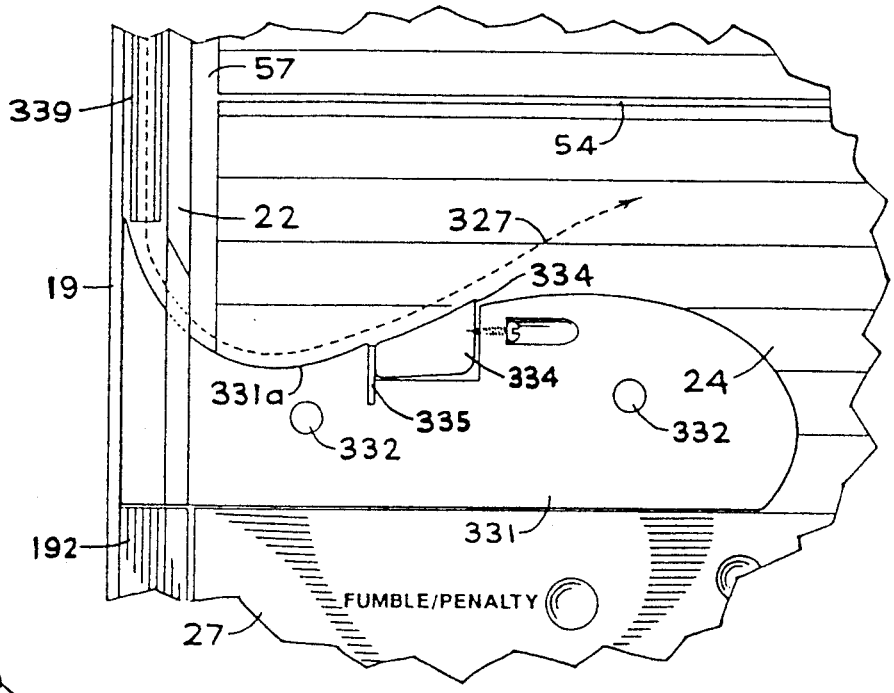
FIG. 17 is a fragmentary plan view with the passing scene removed to show the front end portion of the passing tunnel and the projectile guide mechanism for varying the path of movement of the bearing onto the normally visible part of the scrimmage field.

The mount 331 mounts a pair of magnets 332 for removably attaching a horizontal planar metal plate having a football scene 333 (see FIGS. 4B, 12, 17). The scene 333 extends transversely more remote from the panel 19 than the mount 331 and further longitudinally rearwardly.

Referring to FIGS. 24–26, the magnet player disc (rollable game element) 98, which is made of magnetic material, has opposite sides 481, 482 and a frustoconical peripheral edge 483, the angle of taper being about one to three degrees whereby the angle 484 between side 482 and the surface of 24 is about 99° to 97° when the disc is rolling longitudinally straight ahead such as shown in FIG. 6. As a result of the inclination of edge 483 and the chute in the position shown in FIG. 7 with the side 482 being on the down field side (toward the front end), the disc is in a veering mode, the disc in rolling out of the chute tends to follow the path indicated in FIG. 7 represented by the dotted line having an arrow head pointed to the dotted line showing of the disc. However, if the side 481 is on the down field side and the chute is in the same position for FIG. 7, then the disc is in a curving mode and tends to follow a path such as indicated by the dotted line and an arrow head pointed to the solid line showing of the disc.

The disc is also used for determining the results of fumbles and penalties, side 482 having indicia "V", "keep" and "against you" that faces up when the opposite side of the disc abuts against the scrimmage field. The side 481 has the indicia "C", "turn over" and "against them". The terms "keep" and "turn over" is applicable to fumbles.

Referring to FIG. 27, each of the individual defensive team members (game members), generally designated 488, has a disc shaped platform 489 having a flat bottom surface, and a three dimensional, generally upright team member 490 having his arms outstretched mounted by the platform to extend thereabove. In each hand of each team member there is embedded a piece of iron 491 for being in magnetic attracted relationship to the disc when closely adjacent thereto, the remainder of the team member and the platform preferably being made of plastic (non-magnetic material).

Referring to FIG. 11, the player pocket, generally designated 497, includes a platform 498 having a flat bottom surface and three three dimensional players 499 extending upwardly from the platform. The area of the platform is of a smaller arcuate length than each of the pass pocket areas 72, 73. The relative dimensions of the disc, the platform 489 and team member 490 are such that the team member can relatively easily tip (fall) over when the disc rolls into the team member Sometimes the disc will veer when the disc rolls into the team member, at times the disc striking more than one team member before the disc tips over to fall flat against the scrimmage field. The diameter of the disc is many times greater than the thickness thereof, substantially less than the height of the upright team member 490, and substantially greater than the diameter of the platform 489 (cross sectional area of disc when horizontal, i.e. flat, being greater than the horizontal cross section area of the platform when the team member is upright).

In using the simulated football game of this invention, for running plays, the simulated defensive team members (game members) 488 are placed on the scrimmage line 52 and forwardly thereof. While the defense is arranging its team members, with the huddle in its datum position, the magnetic disc 98 is placed in the chute and pass selector is pivoted to the desired position with the disc being positioned for the curving or veering mode. When the offense says "set", no more adjusting moves can be made other than the defense can move two men across the scrimmage line up to the outer circle 71, or only one man up to the inner circle 74. Now the plunger is pushed down to release the huddle to pivot to its release position whereupon the disc rolls down the scrimmage field. The disc may be stopped (taken down) by one of the defensive team members, either magnetically attaching to the disc or causing the disc to stop rolling earlier than it otherwise would. The downward movement of the plunger also rotating the paddle wheel and the clock gear to move the pointer 157 ahead one indicia. The stopping location of the disc, either the result of being magnetically attached to the piece of iron of a team member or falling flat on the scrimmage field, the forwardmost part of the disc edge representing the gain or loss. The marking wheel 218 is manually rotated whereupon the calculator wheel rotates and moves the mark ball 208 relative to the marking field to represent the gain or loss.

As to passing plays, the chute is aimed so that the disc will roll generally towards the desired one of the pass pockets with the pass selector 97 having its arrow 88 pointing toward one of the pass dots 58, 59, 70. The offense then says "set" and thence the defense makes their one or two man move as referred with reference to running plays. Thereafter the offense places the player pocket in the desired pocket area 72, 73 and the plunger is depressed so that the disc rolls onto the scrimmage field. If the disc fails to touch the player pocket, the play is considered a run. If the disc hits the player pocket and crosses the scrimmage line, it is also considered a run. Otherwise, the offense is considered to have passed the ball.

In the event the offense is considered to have passed the ball and a defensive player is standing on the pass dot that the arrow 88 is pointing toward, the coverage dial 459 is moved to point to the same color dot on the play plate, otherwise the dial 459 is moved to point to dot 472 so that the pass defender is further away from the pass receiver.

Figure 16:
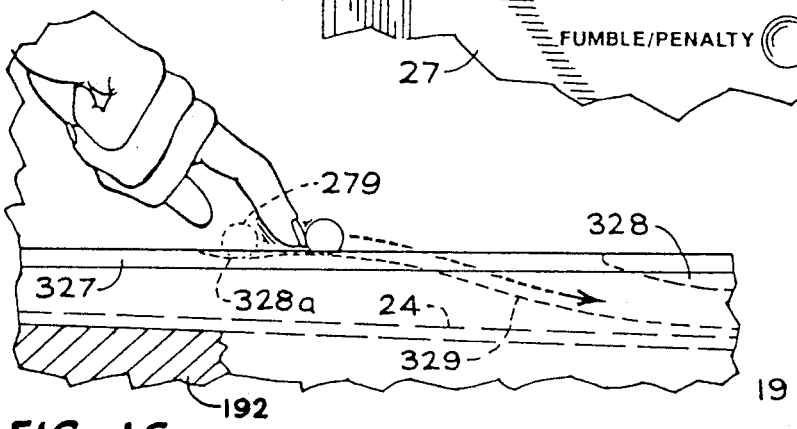
FIG. 16 is a fragmentary side view looking to the rearward end of the passing groove with the spherical bearing being in a position just before moving into the passing groove and in dotted lines in the bearing rest position.

Now the offense takes the bearing from the dispenser receptacle 274, places it in dimple portion 328*a* and pushes it as indicated in FIG. 16 to roll down groove and exit onto the visible portion of the scrimmage field at the forward end portion thereof. The pass is considered to have been completed if the bearing rolls forwardly between the cleats of the pass receiver, intercepted if it rolls forwardly between the cleats of the pass defender, and if trapped by the magnet 470, pass interference and otherwise incomplete. In any event, the bearing rolls to the pass return trough and back to the dispenser 321.

If the pass is completed, in the event the arrow 88 is pointed to one of the dots 58, the bearing is dropped into the medium pass hole 257, and into the hole 258 if the arrow is pointed to one of the dots 70. The bearing drops through the respective one of tubes 252, 251 and onto the calculator wheel. Now the marker wheel 218 is rotated until the respective one of the trailing apertures 233, 232 moves beneath the lower end of the tubes and the bearing drops through the drop tube to hit the click plate 274 that provides a "click" sound. The movement of the marker 208 resulting from the rotation of the marker wheel shows the gain resulting from the completion of the pass.

If the arrow 88 is pointed toward one of the red pass dots 59, the pass is considered a short pass, and instead of using a bearing as used for determining the yardage gained by a medium or long pass, the marker wheel is turned to move, the marker 208 two yards and thence the bearing is dropped into the advance hole 271 to determine the yardage gained by running after the pass completion. The bearing falls onto one of the alternator portions 501*a*, if therebeneath, and remains thereon until moved from therebeneath, and thence onto the calculator wheel, or directly onto the calculator wheel. In either event the marker wheel is rotated until the "click" is heard from the bearing dropping into the return tube 282 to roll to the dispenser receptacle 274.

If the bearing in returning through the tube 282 and a marble rolls onto the scrimmage field as a result of the gate being lowered, it is considered that the ball has been fumbled if the marble is a red marble and if a yellow marble, there is a penalty. When fumbled, the side that is considered to have recovered the ball is determined by the side of the disc that faces upwardly.

It is to be noted that a penalty or fumble can occur whenever the plunger handle is pushed down since one of the marbles may roll outwardly through the case aperture 301. In such an event the bearing is not used to determine the yardage gained by the offense as the result of the pass, nor is the marker moved for a short pass. Rather after the determination that there is penalty against one side or the other If a yellow marble rolls onto the field, the play continues and after, the penalty can be refused or if the penalty is accepted the down is played over. If the yellow marble is after the plunge is pushed: the penalty is 5 yards for a running play and 10 yards for either a passing or a kicking play. The kicking team automatically obtains a first down if the penalty is against the defense.

If a yellow marble rolls out after the "click" while operating the marking wheel: advance a completed pass 10 yards against the defense and if against the offense, 10 yards back from scrimmage.

When there is a fumble, the side of the disc reveals who has recovered. The ball is recovered at the spot the disc is resting. When the red marble rolls out after the disc has traveled the entire scrimmage field the recovery is where the disc is resting while if the fumble occurs after the "click" while operating the marking wheel indicates a fumble at the position of the marker 208 on the marking field.

After a marble has moved from the paddle wheel onto the scrimmage field, the marble is dropped into aperture 307 to return to a paddle wheel pocket.

For kick-offs, the plunger is not used. Rather the marker 307 is moved to the marker field 35 yard line and then the bearing is dropped into the kick-off aperture 270 to fall through the tube 249 and onto the calculator wheel. The marker wheel 307 is thence rotated until the bearing falls through an aperture 232 to result in a "click" sound. For the return of the kick-off the bearing is dropped in the open field aperture 272 to fall through tube 247 either onto the alternator, if therebeneath, or the calculator wheel such as has been described. When the click is heard, it is first and ten.

For field goals and extra points, the bearing may be dropped in any one of the apertures 272, 271, 257, 258 and the marking wheel is turned until the "click" is heard. The kick is good if the "click" sound is heard after the marker 208 reaches the goal line 509 and before reaching the red line 510 which is outside of the end zone.

To go into the punt formation, the player pocket 497 is placed between the pass pocket areas with the front edge thereof touching the outer circle 71 and then the offense says "set". The defense makes their one or two man move and thence the offense pushes the plunger to allow the disc to roll out of the chute 93. The bearing is dropped in the punt aperture 259 and thence the marking wheel is turned until the "click" is heard. The defense returns the punt by dropping the bearing in the advance aperture 271. In the event the disc touches the player pocket but continues on to cross the scrimmage line or go out of bounds the play is treated as a run. The disc must touch the player pocket and stay on side and not touch or cross the scrimmage line in order to get the punt off. To punt out of bounds the defense is so advised and the bearing is dropped in the long pass aperture 258 and the kick goes out of bounds at the sound of the "click".

It is to be understood that the calculator wheel, marking wheel, the dual gear and the apertures in the play plate together with the tubes that said apertures open to can be used games of chance that utilized an appropriately marker field and associated marker mechanism.

What is claimed is:

1. A game for being played by at least one player that has at least one turn during the playing of the game, a frame, a marker that is movable relative to the frame for indicating a player's position during the course of the game, calculator means for at least in part determining the distance of movement of the marker during a game play, the calculator means including a generally horizontal calculator member mounted on the frame for rotation about a generally vertical pivot axis, the calculator member having a generally horizontal top surface and at least two horizontally spaced holes extending vertically therethrough, a game element manually movable by the player and of a size for movement through each of the holes, first means for directing the game element to one of (a) move onto the drop surface in a position to pass through one of the holes as the calculator member is rotated and (b) passing directly through a hole, second means for blocking view of the holes by the player during the course of play, and dispensing and indicating third means for dispensing the game element mounted by the frame for indicating the passage of the game element through one of the holes and returning the element to a dispensing position, and manually operated rotary means mounted on the frame and in engagement with the calculator member for selectively rotating the calculator member until the third means indicates the passage of the element through one of the holes, and fourth means that at least in part includes the second means mounted on the frame for defining a marking field having indicia thereon for showing the player position during the course of the game as indicated by the marker position relative to the frame.

2. The game of claim 1 further characterized in that the rotary means includes a rotary element for being manually rotated by a player and fifth means rotated by the rotary element to rotate the calculator member in only one direction regardless of the direction of rotation of the rotary element.

3. The game of claim 2 further characterized in that the calculator member has a ring of gear teeth, that the fifth means has first and second gears having gear teeth and being rotatable in each of first and second angular directions, sixth means mounted to the frame for mounting the gears in intermeshing relationship such that as the first gear is rotated, the first gear rotates the second gear in the direction opposite the direction of rotation of the first gear means and for movement relative to the calculator member that as the first gear is rotated in one angular direction, the first gear teeth drivingly engages the ring teeth to rotate the calculator member in one angular direction about the vertical pivot axis and when rotated in the second angular direction, the second gear teeth drivingly engages the ring teeth to rotate the calculator member in the same angular direction about the vertical pivot axis that the first gear teeth rotate the calculator member about the vertical axis, and means for drivingly connecting the rotary element to the first gear.

4. The game of claim 3 further characterized in that the sixth means includes first and second shaft means for mounting the first and second gears respectively, the first and second shaft means having first and second central axes that are generally parallel to one another, first and second bracket means for mounting the first and second shaft means respectively, and means mounted on the frame for mounting the first and second bracket means for pivotal movement relatively to one another and relative to the frame to vary the spacing of the shaft means axes relative to one another.

5. The game of claim 1 further characterized in that the rotary means includes a rotary element for being rotated by a player and that the calculator means includes means driven by the rotation of the rotary means and connected to the marker for moving the marker relative to the marking field as the rotary element is rotated.

6. The game of claim 5 further characterized in that the frame has a front end portion and a rear end portion, that the fourth means includes scrimmage means defining a scrimmage field, the scrimmage field having a front end portion, a rear end portion and fore and aft spaced indicia thereon to indicate yard lines, and being downwardly sloped toward the front end portion,

7. The game of claim 6 further characterized in that there is provided a rollable game element, a chute pivotably mounted adjacent to the scrimmage field for directing the game element to roll toward the forward end portion, a huddle device movable relative to the scrimmage field between a position for blocking view of the game element from the forward end portion of the scrimmage field and retaining the game element in the chute, and a game element release position to permit the game element rolling out of the chute and onto the scrimmage field and permitting the viewing of the chute from the forward end portion of the scrimmage field, means mounting the huddle device to the frame rear end portion for movement between the huddle device blocking and release positions, means for resiliently urging the huddle device to its release position, operable release means on the frame for releasably latchingly engaging the huddle device in the huddle device latching engaging position, and player operated means mounted on the frame for operating the release means to release the huddle device to permit the huddle device resiliently moving to the huddle device release position.

8. The game of claim 7 further characterized in that the game is a simulated football game, that the scrimmage field is at least a portion of the simulated football field, a round element to indicate one of a fumble and a penalty, carrier means operated by each operation of the player operated means for movement from a round element receiving position to a round element discharge position by the player operated means being operated a plurality of times by a player, the carrier means in been operated moving the round element from the receiving position to the discharge position, the carrier means including means for blocking the viewing of the round element as the round element is moved by the carrier means from the receiving position to at least the discharge position.

9. The game of claim 7 further characterized in that the carrier means includes a paddle wheel having a plurality of circumferential round elements pockets, a shaft mounted on the frame for rotating the paddle wheel, chute means mounted by the frame for directing the round element to the carrier means receiving position to move into one of the pockets and means for directing the round element in the carrier means discharge position to roll onto one of the fields.

10. The game of claim 9 further characterized in that there are provided at least two round elements that includes a first round element and a second round element of a different color than the first round element, the first round element indicating a fumble and the second element indicating a penalty.

11. The game of claim 9 further characterized in that the game element is a magnetic disc having a circular peripheral surface and axially opposite side surfaces and of a thickness to tip to have one of its side surfaces in abutting relationship to the scrimmage field, that there are provided a plurality of uprightable defense games members having platform portions for abutting against the scrimmage field when the game members are upright and are tippable from being upright by being impacted by the disc when the disc is rolling on the scrimmage field, the game members at least in part being made of a material that is magnetically attachable to the disc to aid in stopping movement of the disc on the scrimmage field.

12. A simulated football game to be played by at least one player that has more than one turn simulating a play to ascertain the yardage a marker is to be moved and representing yardage gained or lost for each play during the course of the game, comprising a frame having a front end portion and a rear end portion, scrimmage means mounted on the frame for defining at least a part of a scrimmage field having indicia indicating yard lines, and yard determining means for determining the yardage the marker is moved and the one of yardage gained and yardage lost during the play, the yard determining means including at least two rollable members, at least one rollable member being of a first color to indicate a fumble and at least one rollable member being of a second color to represent a penalty, a rotatable carrier having a plurality of circumferentially spaced pockets for receiving and discharging a rollable member, discharge and mounting means mounted on the frame for mounting the carrier for rotation between a rollable member receiving position permitting a rollable member moving into an adjacent carrier pocket and an angularly spaced discharge position permitting the discharge of a rollable member from a carrier pocket and directing a discharged rollable member onto the scrimmage field, directing means opening through the discharge and mounting means for directing a rollable member into a carrier pocket when the last mentioned pocket is in the carrier pocket receiving position, and manual operable means operated by a player for each play for rotating the carrier a preselected angular distance, at least one of the carrier and discharge and mounting means having means for blocking observation of a rollable member in a carrier pocket until at least a rollable member in a carrier pocket has been rotated to the carrier discharge position.

13. The game of claim 12 further characterized in that the carrier has an axis of rotation, and axially opposite first and second sides, at least one pocket when in the rollable member discharge position being inclined to discharge through the first side and at least one pocket when in the rollable member discharge position being inclined to discharge through the second side, the discharge and mounting means including stop means adjacent to the first side for preventing a rollable member moving out a pocket through the first side.

14. The game of claim 13 further characterized in that the stop means includes a stop member mounted axially adjacent to the first side for movement between a blocking position preventing a rollable member moving out a pocket and through the first side when the last mentioned pocket is in the pocket discharge position and a release position permitting a rollable member moving through the first side and out of a pocket when in said last mentioned position, and ascertaining means mounted on the frame for ascertaining any yardage gained by a simulated pass play, the ascertaining means including means for operating the stop member from the stop member blocking position to the stop member release position.

15. The game of claim 14 further characterized in that the ascertaining means includes a rollable element, a calculator wheel mounted on the frame for rotary movement about a generally vertical axis and having at least an annular, generally planar, horizontal top surface portion and angularly spaced holes extending axially through the annular surface portion for the rollable element to vertically move through, manually operated means for rotating the wheel about the wheel axis, means for receiving and directing the rollable element to move one of into a wheel hole and onto the wheel surface portion and retain the game element on the wheel surface portion until the wheel has been rotated to have one of the wheel holes rotated therebeneath, and means for indicating the passage of the game element through a wheel hole and moving the stop member from its blocking position to its release position upon the rollable element moving through the wheel hole.

16. The game of claim 15 further characterized in that the manually operable means includes rotary means mounted on the frame for rotation in the selected one of opposite angular directions and intermeshing gear means for rotating the wheel in only one direction regardless of the direction of rotation of the rotary means.

17. The game of claim 15 further characterized in that the scrimmage field is inclined in a downward direction from the rear edge portion toward the front edge portion and that the yard determining means includes run yard means cooperating with the scrimmage field for simulating a running play and one of moving the marker position and indicating the change of marker position to be made as the result of a running play, the run yard means including a disc having axially opposite sides and a peripheral edge of relative dimensions that the disc will readily tip from a position rolling on the scrimmage field that the peripheral edge rolls along the scrimmage field to have one side abut against the scrimmage field after the termination of rolling along the scrimmage field, chute means mounted on the frame rear end portion for directing the disc to roll onto the scrimmage field in a direction away from rear end portion and means for releasably retaining the disc in the chute means.

18. The game of claim 17 further characterized in that the disc peripheral edge is of a frustoconical shape and that the releasably retaining means comprises means simulating a huddle and mounted on the frame rear end portion for movement between a first position blocking observation of the disc in the chute means and retaining the disc in the chute means and a release position permitting the disc rolling out of the chute means and onto the scrimmage field, means for constantly urging the huddle means to the huddle means release position, and operable means for latchingly engaging the huddle means to retain the huddle means in the huddle means blocking position.

19. A simulated football game for being played by at least one player that has more than one turn simulating a play and ascertaining simulated yardage gained or lost for each play during the course of the game, comprising a frame having a front end portion and a rear end portion, field means mounted on the frame for defining at least a portion of a football field having indicia indicating yard lines, a marker simulating a football for indicating the position of a football relative to the field, a generally horizontal calculator member mounted on the frame for movement about a generally vertical pivot axis, the calculator member having a generally horizontal top surface and at least two horizontal spaced holes extending vertically therethrough, a game element manually movable by the player and of a size for movement through the holes, first means for directing the game element to one of (a) move onto the planar surface in a position to pass through one of the holes as the calculator member is pivoted and (b) passing directly through a hole, and dispensing and indicating second means mounted by the frame for dispensing the game element for indicating the passage of the game element through one of the holes and returning the element to a position for being used by a player, and manually operated rotary means mounted on the frame and in engagement with the calculator member for selectively pivoting the calculator member until the second means indicates the passage of the element through one of the holes, the rotary means including hand rotary mechanism and gear means for drivingly rotating the calculator member in only one direction regardless of the direction that the rotary mechanism is rotated, the rotary mechanism being connected to the gear means for rotating the gear means.

20. The game of claim 19 further characterized in that there is provided means mounted on the frame and connected to the marker for moving the marker in the selected one of a first direction and an opposite direction that depends on the direction of rotation and the angular degree of rotation of the rotary mechanism.

21. The game of claim 19 further characterized in that there is provided means for indicating when one of a fumble has occurred and a penalty is to be assessed during a play, the fumble and penalty means including at least two rollable members, at least one rollable member being of a first color to indicate a fumble and at least one rollable member being of a second color to represent a penalty, a rotatable carrier having a plurality of circumferentially spaced pockets for receiving and discharging a rollable member, discharge and mounting means mounted o the frame for mounting the carrier for rotation between a rollable member receiving position permitting a rollable member moving into an adjacent carrier pocket and an angularly spaced discharge position permitting the discharge of a rollable member from a carrier pocket and directing a discharged rollable member onto the field means, directing means opening through the discharge and mounting means for directing a rollable member into a carrier pocket when the last mentioned pocket is in the carrier pocket receiving position, and operable means operated by a player for each play for rotating the carrier a preselected angular distance, at least one of the carrier and discharge and mounting means having means for blocking observation of a rollable member in the carrier until at least a rollable member in a pocket is in the carrier discharge position.

22. A simulated game to be played by at least one player that has more than one turn simulating a play to ascertain the distance a marker is to be moved and representing the units of distance that the marker is to be advanced or retreated, comprising a longitudinally extending game board having a first end portion and a longitudinally opposite second end portion and a plurality of longitudinally spaced, transversely extending indicia representing units of distance, a magnetic disc rollable onto the game board in an upright rolling condition and being tippable relative to the game board from the upright condition to a magnetic disc flat condition to indicate the units that the marker is to be moved, first means for directing the disc onto the game board in an upright condition in a direction to move away from the first end portion, and at least one uprightable game member that is movably positionable on the game board intermediate the first means and the game bard first end portion in a position to impede the movement of the disc on the board and being tippable from an upright position by the disc, the game member at least in part incorporating iron material that is at least of one being magnetically attracted to and magnetically attachable to the magnetic disc when the magnetic disc rolls adjacent thereto.

23. The game of claim 22 wherein the first means includes an inclined chute pivotally mounted on the game board second end portion, and that there is provided at least one uprightable game member that movable positionable on the game board intermediate the chute and the game board first end portion in a position to impede the movement of the disc on the board and being tippable from an upright position by the disc.

24. The game of claim 23 wherein the game is a simulated football game, the disc in rolling onto the game board simulates a running play, there is provided a frame that mounts the game board in an inclined condition sloping downwardly from the second end portion toward the first end portion, the game board having means defining a scrimmage field and a marking field longitudinally opposite the scrimmage field from the chute, the marker field having second indicia simulating a football field, operable means mounted on the frame for mounting the marker and moving the marker along the marker field and means for simulating a pass play, the pass play means including rotary calculator means for determining the distance of movement of the marker along the marker field as a result of a simulated pass and manually rotatable means for rotating the calculator means and operating the operable means to move the marker, the disc has a frustoconical periphery edge, and the game member at least in part incorporates iron material that is at least of one being magnetically attracted to and magnetically attachable to the magnet when the magnet rolls adjacent thereto.

25. The game of claim 22 wherein the first means includes an inclined chute pivotally mounted on the game board second end portion, and the disc has a frustoconical periphery edge.

26. A simulated football game to be played by at least one player that has more than one turn simulating a play to ascertain the distance a marker is to be moved and representing the units of distance that the marker is to be advanced or retreated, comprising a longitudinally extending game board having a first end portion and a longitudinally opposite second end portion and a plurality of longitudinally spaced, transversely extending indicia representing units of distance, a magnetic disc rollable onto the game board in an upright rolling condition and being tippable relative to the game board from the upright condition to a magnetic disc flat condition to indicate the units that the marker is to be moved, the disc having a frustoconical peripheral edge and in rolling onto the game board simulating a running play, first means for directing the disc onto the game board in an upright condition in a direction to move away from the first end portion, the first means including an inclined chute pivotally mounted on the game board second end portion, a frame mounting the game board in an inclined condition sloping downwardly from the second end portion toward the first end portion, the game board having means defining a scrimmage field and a marking field longitudinally opposite the scrimmage field from the chute, the marker field having second indicia simulating a football field, at least one uprightable game member that movable positionable on the game board intermediate the chute and the game board first end portion in a position to impede the movement of the disc on the board and being tippable from an upright position by the disc, the game member at least in part incorporating iron material that is at least of one being magnetically attracted to and magnetically attachable to the magnet when the magnet rolls adjacent thereto, operable means mounted on the frame for mounting the marker and moving the marker along the marker field, means for simulating a pass play, the pass play means including rotary calculator means for determining the distance of movement of the marker along the marker field as a result of a simulated pass and manually rotatable means for rotating the calculator means and operating the operable means to move the marker.

* * * * *